US005634284A

United States Patent [19]

MacPhail

[11] Patent Number: 5,634,284

[45] Date of Patent: *Jun. 3, 1997

[54] FIT AND SUPPORT SYSTEM FOR THE FOOT

[75] Inventor: David M. MacPhail, Whistler, Canada

[73] Assignee: Macpod Enterprises Ltd., Willowdale, Canada

[ * ] Notice: The term of this patent shall not extend beyond the expiration date of Pat. No. 5,265,350.

[21] Appl. No.: 485,488

[22] Filed: Jun. 7, 1995

Related U.S. Application Data

[60] Division of Ser. No. 159,341, Nov. 29, 1993, Pat. No. 5,459,949, which is a continuation-in-part of Ser. No. 831, 241, Feb. 3, 1992, Pat. No. 5,265,350, which is a continuation-in-part of Ser. No. 794,674, Nov. 18, 1991, abandoned, which is a continuation of Ser. No. 511,898, Apr. 23, 1990, abandoned, which is a continuation-in-part of Ser. No. 342,971, Apr. 25, 1989, abandoned, and a continuation of Ser. No. 633,188, Dec. 28, 1990, abandoned.

[51] Int. Cl.[6] ..... A43B 5/04; A43B 5/00; A43B 23/28

[52] U.S. Cl. ..... 36/117.6; 36/117.9; 36/88; 36/93; 36/97

[58] Field of Search ..... 36/117, 118, 119, 36/120, 121, 115, 92, 88, 68, 69, 93, 97, 155, 160

[56] References Cited

U.S. PATENT DOCUMENTS

| | | | |
|---|---|---|---|
| 3,431,658 | 3/1969 | Finn | 36/97 |
| 3,812,602 | 5/1974 | Gertsch et al. . | |
| 4,083,128 | 4/1978 | Rossman | 36/97 |
| 4,581,831 | 4/1986 | Kirsch | 36/119 |
| 4,615,127 | 10/1986 | Delery | 36/117 |
| 4,718,181 | 1/1988 | Olivieri | 36/119 |
| 4,772,041 | 9/1988 | Klosterman | 36/97 |
| 4,800,659 | 1/1989 | Marega | 36/199 |
| 4,922,634 | 5/1990 | Seidel | 36/119 |
| 4,937,951 | 7/1990 | Loecker | 36/119 |
| 5,265,350 | 11/1993 | MacPhail | 36/88 |
| 5,459,949 | 10/1995 | MacPhail | 36/88 |

*Primary Examiner*—M. D. Patterson
*Attorney, Agent, or Firm*—Elbie R. de Kock

[57] ABSTRACT

A footwear device (2000) comprises a rigid base (2100) for supporting the foot (2001) of a user thereon, a heel counter (2300) on the rigid base (2100) for contact with the foot (2001) of a user in a first area of the foot posterior to the posterior aspect of the heel of the foot, a medial forefoot counter (2201) associated with the rigid base (2100) for contact with the foot (2001) of a user in a second area of the foot medial to the medial aspect of the head of the first metatarsal of the foot, and a forefoot/midfoot compression member (2400) for contact with the foot (2001) of a user in a third area of the foot located on the dorsum of the foot for exerting a downwardly and rearwardly directed force on the dorsum of the foot. The footwear device (2000) further includes a sports implement interface member (2101) on the rigid base (2100) for interfacing with a sports implement, such as a snow ski, or an ice skate blade or an in-line skate wheel system. The interface member (2101) is movable in a medial/lateral direction with respect to a user's foot (2001) into different positions relative to the rigid base 2100 and includes means for selectively locking the interface member (2101) in one of the positions relative to the rigid base (2100). The footwear device 2000 also includes other features, such as an instep counter (2420) which is pivotable about two different axes relative to the rigid base (2100), stops (2436, 2437) for limiting the pivotal movement of the instep counter (2420), an adjustable heel counter (2300) and an adjustable medial forefoot counter (2201).

4 Claims, 14 Drawing Sheets

FIT AND SUPPORT SYSTEM FOR THE FOOT

CROSS-REFERENCE TO RELATED APPLICATIONS

This application is a divisional of U.S. patent application Ser. No. 08/159,341, filed Nov. 29, 1993 now U.S. Pat. No. 5,459,949, which, in turn, is a continuation-in-part of U.S. patent application Ser. No. 07/831,241, filed Feb. 3, 1992 now U.S. Pat. No. 5,265,350, which, in turn, is a continuation-in-part of U.S. patent application Ser. No. 07/794,674, filed Nov. 18, 1991 now abandoned, which, in turn, is a continuation of U.S. patent application Ser. No. 07/511,898, filed Apr. 23, 1990, now abandoned; which, in turn, is a continuation-in-part of U.S. patent application Ser. No. 07/342,971, filed Apr. 25, 1989, now abandoned in favour of continuation U.S. patent application Ser. No. 07/633,188, filed Dec. 28, 1990 now abandoned. The contents of the foregoing applications are incorporated herein by reference.

FIELD OF THE INVENTION

This invention relates to a fit and support system for the foot and, more particularly, but not exclusively, to a fit and support system or footwear device suitable for sports footwear, such as ski boots, hockey skates, cycling shoes and the like. Thus, the invention relates in particular, but not exclusively, to applications where the footwear device serves as a connection means between the foot and sports equipment such as a ski, ice skate blade, in-line roller skate wheels or a bicycle pedal.

BACKGROUND OF THE INVENTION

A footwear device which connects the foot of a user to an appliance such as a snow ski, in-line wheel system and ice blades, while permitting substantially unrestricted articulation of the elements of the foot associated with movement between bipedal (neutral) and monopedal (pronated) stances, is described in WO 93/14656A. The device described in WO 93/14656A, is shown in FIGS. 1 and 2. It is generally indicated at 2000 and comprises four primary elements, i.e. a rigid base 2100, a medial forefoot counter 2201, a heel counter, generally shown at 2300, and a forefoot/midfoot compression member generally shown at 2400. In some applications, a leg member, generally shown at 2500, is added to the four primary elements.

The four primary elements are interrelated and interdependent in terms of producing an overall effect of controlling the position and displacements of the foot of a user relative to the rigid base 2100. When added to the four primary elements, the leg member 2500 acts in concert with the rigid base 2100 to control the movement of the leg relative to rigid base 2100.

The forefoot/midfoot compression member 2400 acts to apply a primary force to the dorsum of the foot which force is directed perpendicular to the rigid base 2100 and directed posteriorly towards the heel counter 2300. The forefoot/midfoot compression member 2400 simultaneously acts to apply a secondary force to the superolateral aspect of the first metatarsal directed inferomedially towards medial forefoot counter 2201. The primary force compresses the arches of the foot in a manner which mimics the compression of the arches of the foot resulting from the weight of the superincumbent body in bipedal stance. The heel counter 2300 establishes the rearward or posterior position of the heel of the user on the rigid base 2100. The secondary force acts to control the position of the head of the first metatarsal as it advances and recedes on the rigid base 2100 as the arches of the foot compress and decompress when moving between bipedal and monopedal stances.

Thus, the footwear device 2000 confines the foot of the user within an arrangement of structure from which it cannot escape once the device has applied a compressive force to the arches of the foot of the user. At the same time the device creates an environment wherein the forces applied to the device by the elements of the foot when moving between bipedal and monopedal stances are significantly greater than any opposing forces applied by the device to the foot so that the animation of the elements of the foot required to move between bipedal and monopedal stances is substantially unrestrained.

The present invention comprises further improvements to the footwear device described above.

SUMMARY OF THE INVENTION

According to the invention, there is provided a footwear device comprising a rigid base for supporting the foot of a user thereon; a heel counter on the rigid base for contact with the foot of a user in a first area of the foot posterior to the posterior aspect of the heel of the foot; a medial forefoot counter associated with the rigid base for contact with the foot of a user in a second area of the foot medial to the medial aspect of the head of the first metatarsal of the foot; and a forefoot/midfoot compression member for contact with the foot of a user in a third area of the foot located on the dorsum of the foot for exerting a downwardly and rearwardly directed force on the dorsum of the foot, characterized in that the footwear device includes a sports implement interface member on the rigid base for interfacing with a sports implement and including means for attaching a sports implement thereto, wherein the interface member is movable in a medial/lateral direction with respect to a user's foot into different positions relative to the rigid base and including means for selectively locking the interface member in one of the positions relative to the rigid base.

Also according to the invention, there is provided a footwear device comprising an elongate rigid base for supporting the foot of a user thereon; a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with the heel counter, wherein the forefoot/midfoot compression member comprises an instep counter and a support member for the instep counter attached to the rigid base, wherein the instep counter is pivotally connected to the support member about a pivot axis which is transverse to the rigid base so that the instep counter is pivotally or swivelably supported relative to the rigid base, characterized in that the support member is provided with a stop on the opposite side of the pivot axis with reference to the user's foot, the stop being located above the instep counter for limiting the extent of pivotal movement of the instep counter about the pivot axis.

Further according to the invention, there is provided a footwear device comprising an elongate rigid base for supporting the foot of a user thereon; a heel counter on the rigid base for contact with the foot of a user posterior to the posterior aspect of the heel of the foot; and a forefoot/midfoot compression member for exerting a downwardly and rearwardly directed force on the dorsum of the foot of the user to maintain the posterior aspect of the heel in contact with the heel counter, wherein the forefoot/midfoot compression member comprises an instep counter, and a support member for the instep counter attached to the rigid base, characterized in that the instep counter is pivotally connected to the support member about a first pivot axis which is transverse to the rigid base; and wherein the instep counter is further pivotally connected to the support member about a substantially vertical second pivot axis which is located in the vicinity of the head of the first metatarsal of the foot of the user so that the instep counter is supported relative to the rigid base for pivotal movement about a pair of different pivot axes.

Also according to the invention, there is provided a footwear device comprising: a rigid base for supporting the foot of a user thereon; a heel counter on the rigid base for contact with the foot of a user in a first area of the foot posterior to the posterior aspect of the heel of the foot; a medial forefoot counter associated with the rigid base for contact with the foot of a user in a second area of the foot medial to the medial aspect of the head of the first metatarsal of the foot; and a forefoot/midfoot compression member for contact with the foot of a user in a third area of the foot located on the dorsum of the foot for exerting a downwardly and rearwardly directed force on the dorsum of the foot, characterized in that the medial forefoot counter is movable in a direction medially/laterally with respect to the foot into different positions relative to the rigid base and including means for selectively locking the medial forefoot counter in one of said positions.

Further according to the invention, there is provided a footwear device comprising: a rigid base for supporting the foot of a user thereon; a heel counter on the rigid base for contact with the foot of a user in an area of the foot posterior to the posterior aspect of the heel of the foot; and a forefoot/midfoot compression member for contact with the foot of a user in an area of the foot located on the dorsum of said foot for exerting a downwardly and rearwardly directed force on the dorsum of the foot, characterized in that the heel counter is movable in a direction anteriorly/posteriorly with respect to said foot into different positions relative to said rigid base and including means for selectively locking said heel counter in one of said positions.

Also according to the invention, there is provided a footwear device comprising a rigid base for supporting the foot of a user thereon; a heel counter on the rigid base for contact with the foot of a user in a first area of the foot posterior to the posterior aspect of the heel of the foot; a medial forefoot counter for contact with the foot of a user in a second area of the foot medial to the medial aspect of the head of the first metatarsal of the foot; and a forefoot/midfoot compression member for contact with the foot of a user in a third area of the foot located on the dorsum of said foot for exerting a downwardly and rearwardly directed force on the dorsum of the foot, characterized in that the footwear device further includes first adjusting means for adjusting the medial forefoot counter in a direction medially/laterally with respect to the foot into different first positions relative to the rigid base, first locking means for selectively locking the medial forefoot counter in one of the first positions, second adjusting means for adjusting the medial forefoot counter in a direction anteriorly/posteriorly of the foot of a user into different second positions with respect to the rigid base and second locking means for selectively locking the medial forefoot counter in one of the second positions.

Further according to the invention, there is provided a footwear device comprising a rigid base for supporting the foot of a user thereon; a heel counter on the rigid base for contact with the foot of a user in an area of the foot posterior to the posterior aspect of the heel of the foot; and a forefoot/midfoot compression member for contact with the foot of a user in an area of the foot located on the dorsum of the foot for exerting a downwardly and rearwardly directed force on the dorsum of the foot, characterized in that the footwear device includes first adjusting means for adjusting the heel counter in a direction anteriorly/posteriorly with respect to the foot into different first positions relative to the rigid base, first locking means for selectively locking the heel counter in one of the first positions, second adjusting means for adjusting the heel counter in a direction medially/laterally of the foot into different second positions with respect to the rigid base and second locking means for selectively locking the heel counter in one of the second positions.

Further objects and advantages of the invention will become apparent from the description of a preferred embodiment of the invention below.

DESCRIPTION OF SPECIFIC EMBODIMENT

In the application of footwear device 2000 to footwear in which an external appliance such as a skate ice blade, in-line skate wheel system, snow ski or the like, is affixed in some manner to the sole of the footwear, the need arises to position the foot of the user in relation to the external appliance. This need arises because the user must be able to balance specific forces and moments acting on the external appliance while simultaneously directing force to the appliance. The affixing of such appliances to the sole of the footwear in a known manner can create problems for the user since the point of contact of the appliance with the interactive surface, be it asphalt, ice or snow, can act as a fulcrum and, in so acting, establish moment arms which the physiology of the user must counteract if an upright posture is to be established and maintained. Correct alignment of the foot in relation to such appliances is one of the objects of the embodiments which follow, since such facility is important in footwear for ice skating, in-line skating and snow skiing and is thus advantageous to the user.

There also exists a need in the economical production of footwear to adapt, and thus utilize, components, in particular those which make up the outer shell, to a broad application in terms of the consumer. However, structures utilized to allow such broad application, while predicated on economy of production cost, must also provide for the correct and satisfactory operation of the footwear. It is particularly desirous, in the case of the alpine ski boot, for example, whose outer shell is typically molded of a substantially rigid plastic of sorts, to utilize outer shells for a broad range of foot and leg sizes and yet still provide for the correct and satisfactory operation of the footwear. Thus, the invention provides means to allow the position of structures within the outer shell of the footwear, for example, medial forefoot counter 2201, heel counter 2300 and instep counter 2420, to be readily adjusted so as to make contact with the relevant discrete aspects of the foot of the individual user while leaving other areas of the foot and leg relatively free of restraint. Means is also provided to allow for the substitution or modification of structures of a form more suited to the individual user.

Figure 1:
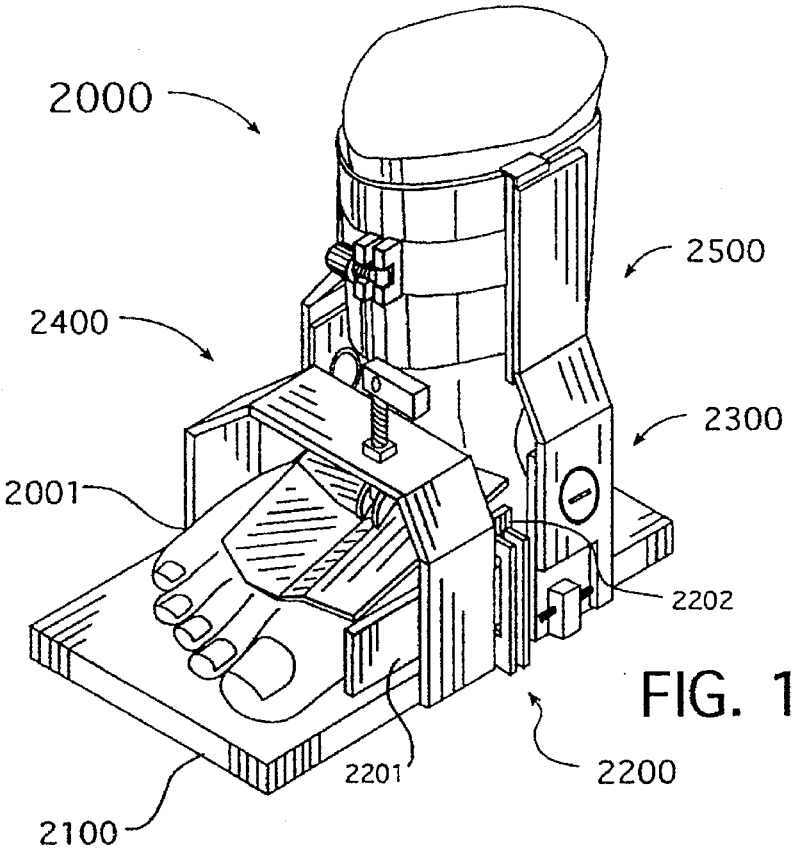
FIG. 1 is a diagrammatical illustration showing the major elements of a fit and support system or footwear device.
Figure 2:
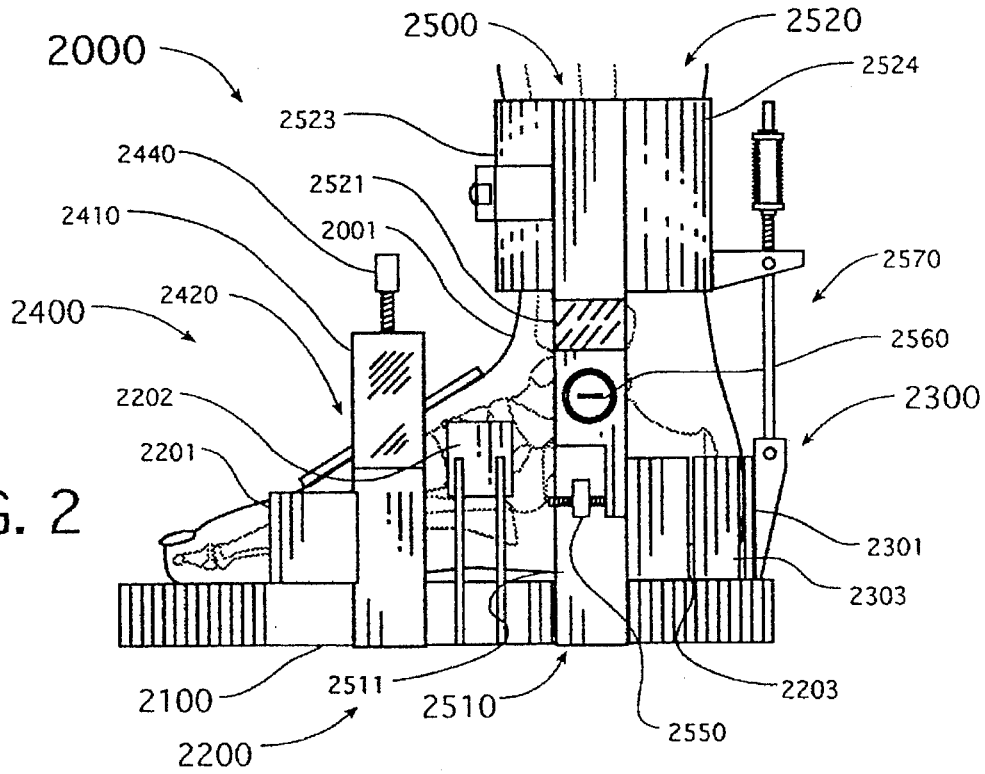
FIG. 2 is a medial elevation of the footwear device of FIG. 1.
Figure 3:
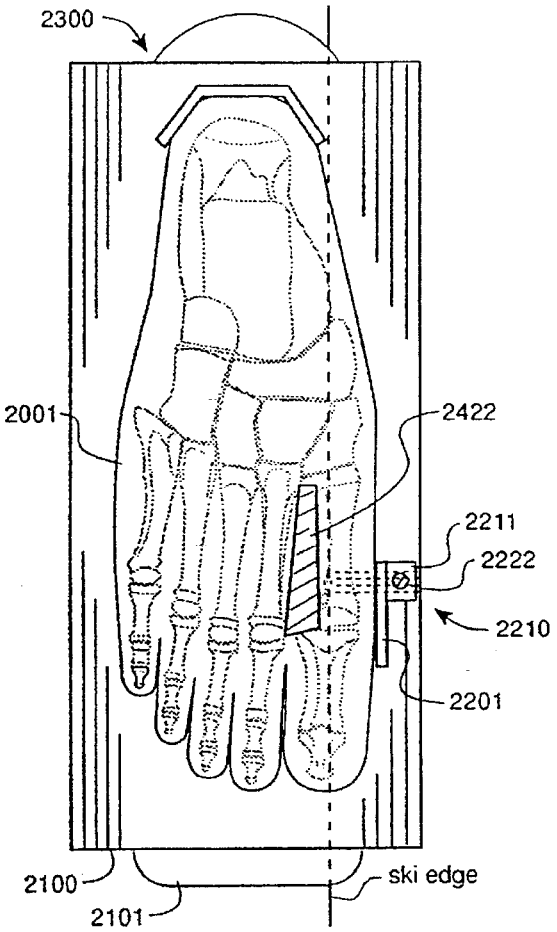
FIG. 3 is a superior plan view of a rigid base and medial and superolateral counters of a footwear device according to the invention, with the foot of a user positioned thereon in contact with the counters.

FIG. 3 shows a plan view of the rigid base 2100 with the foot of a user 2001 positioned thereon so as to contact the heel counter 2300, medial forefoot counter 2201 and superolateral first metatarsal counter 2422. The sole of the footwear, which serves as the interface for the attachment by known means to snow skis, skate ice blades, in-line skate wheel systems and the like, is shown at 2101. Other parts of the footwear device 2000 have been omitted for the sake of clarity. A dashed line running longitudinally substantially through the center of the head of the first metatarsal represents the position of the inside edge of a snow ski in the event one were to be affixed to sole 2101.

Medial forefoot counter 2201 is fitted with a retention means generally shown at 2210 which incorporates a base plate 2211. Base plate 2211 acts as a mounting device to affix medial forefoot counter 2201 to the superior surface of rigid base 2100. An inverted threaded flat head screw 2221 (FIG. 4) can move within a slot 2223 formed in the side of rigid base 2100 and which extends mediolaterally in the interior of rigid base 2100. The threaded portion of flat head screw 2221 extends superiorly through the superior surface of rigid base 2100. Base plate 2211 has a receiving hole through which flat head screw 2221 extends when base plate 2211 is positioned on rigid base 2100. Threaded cap 2222 threads onto the receiving threads of flat head screw 2221 such that medial forefoot counter 2201 is secured to rigid base 2100 and its position fixed when threaded cap 2222 is tensioned against flat head screw 2221.

Figure 4:
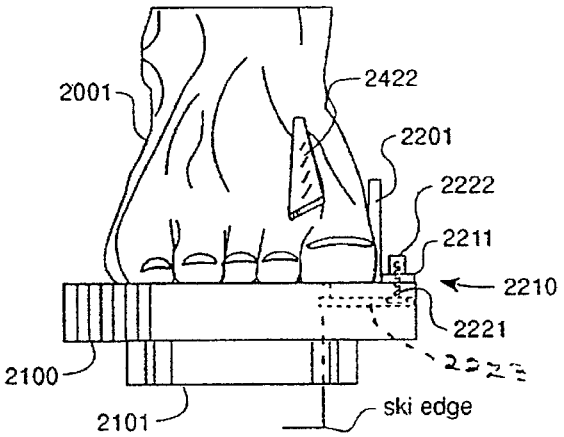
FIG. 4 is an anterior elevation of the rigid base and medial and superolateral counters of the footwear device of FIG. 3, with the foot of a user positioned thereon in contact with the counters.

FIG. 4 shows an anterior elevation of the foot. The structure of footwear device 2000 is as shown in FIG. 3. The adjustment slot 2223 in which the inverted flat head screw 2221 can move within rigid base 2100 is shown with dashed lines as is flat head screw 2221. A separate dashed line represents substantially the position where the inside edge of a snow ski would be located in the event one were affixed to sole 2101.

When tension is released on base plate 2211 by backing off threaded cap 2222, retention means 2210 along with medial forefoot counter 2201 can be shifted medially or laterally on rigid base 2100 to the desired location within the range of adjustment provided by the slot 2223. The advantage of such an arrangement is that medial forefoot counter 2201 is now independent of rigid base 2100. It can thus he removed and replaced with a medial forefoot counter of different specification or adjustments can be made to the counter's position on rigid base 2100.

Figure 5:
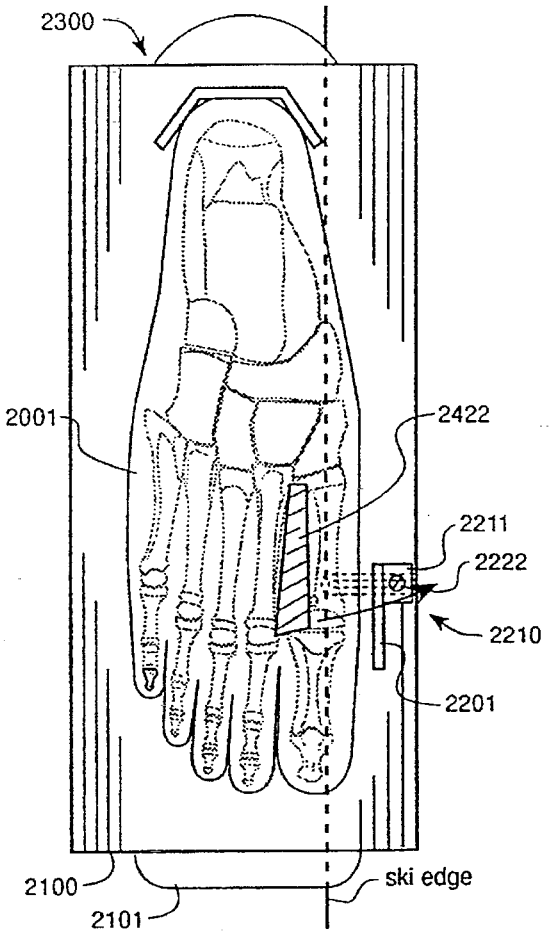
FIG. 5 is a superior plan view of the rigid base and associated counters of the footwear device of FIG. 3 with the foot of a user positioned thereon but not in contact with the medial forefoot counter.

FIG. 5 shows the same view as FIG. 3 except that the foot 2001 of the user positioned on rigid base 2100 is narrower in width than the foot 2001 of the user shown in FIG. 3 with the effect that, with the foot correctly aligned longitudinally on rigid base 2100, the medial aspect of the head of the first metatarsal is not in contact with the lateral face of medial forefoot counter 2201. For the medial aspect of the head of the first metatarsal to contact the lateral face of medial forefoot counter 2201 requires that the foot rotate medially. An arrow indicates the required direction of rotation of the forefoot of the user. Rotating the foot on rigid base 2100 in order to allow the medial aspect of the first metatarsal to contact the lateral face of medial forefoot counter 2201 is disadvantageous and potentially stressful to the user since such a manoeuvre will result in an inverted position of the foot in relation to the correct alignment of the foot on rigid base 2100 shown in FIG. 3.

Figure 6:
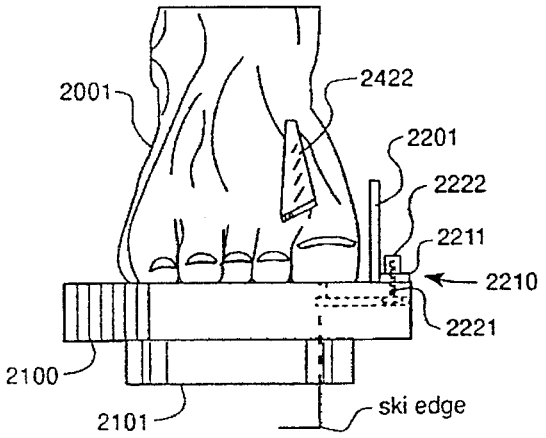
FIG. 6 is an anterior elevation of the rigid base and associated counters of the footwear device of FIG. 3, with the foot of a user positioned thereon but not in contact with the medial forefoot counter.

FIG. 6 shows an anterior elevation of the foot 2001 of a user positioned on rigid base 2100 of footwear device 2000 showing the space between the lateral face of medial forefoot counter 2201 and the medial aspect of the head of the first metatarsal.

Figure 7:
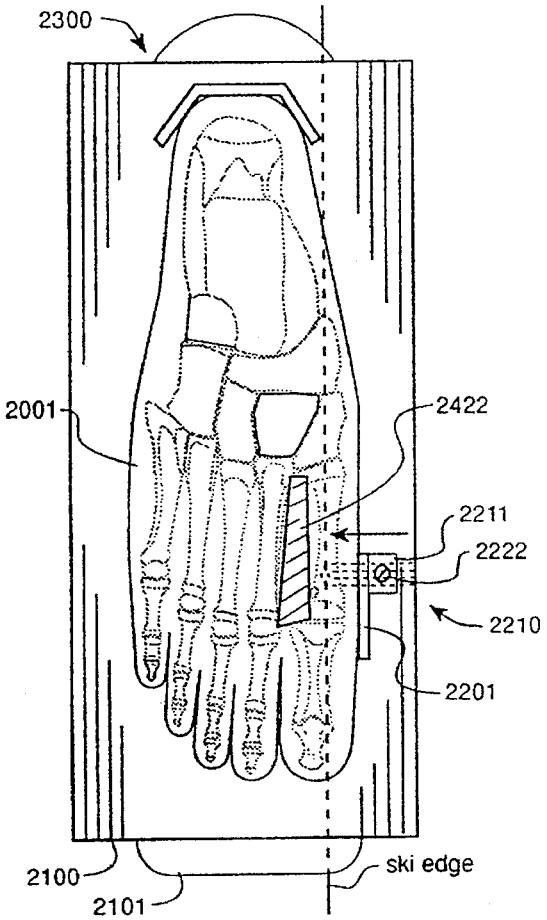
FIG. 7 is a superior plan view of the rigid base and associated counters of the footwear device of FIG. 3, with the foot of a user positioned thereon in contact with the counters.

FIG. 7 shows substantially the same view as FIG. 5 except that in FIG. 7 medial forefoot counter 2201 has been shifted laterally so as to contact the medial aspect of the head of the first metatarsal of the foot 2001 of the user with the foot correctly aligned longitudinally on rigid base 2100. An arrow indicates the direction medial forefoot counter has been shifted on rigid base 2100.

While the adjustment of medial forefoot counter 2201 enables the foot 2001 of the user to be correctly aligned on rigid base 2100 yet another problem has arisen. The alignment of the head of the first metatarsal of the foot 2001 of the user has been altered in relation to the appliance affixed to the sole of the footwear, in this instance, a snow ski, in comparison with the alignment of the appliance in relation to the head of the first metatarsal as shown in FIG. 3.

Alignment of the center of the head of the first metatarsal is an important factor influencing physiological mechanisms which balance pronation/supination moments acting transversely across inside edge of appliances such as snow skis. The contact point of such an appliance with the surface on which it is acting can act as a fulcrum and, in so acting, establish a moment arm pivot in situations where the ground reaction force and the force applied by the user are not acting linearly in opposition to each other. In monopedal stance the weight of the body acts substantially through the center of the head of the first metatarsal.

It is important, in activities such as snow skiing, that means be provided to allow the center of the head of the first metatarsal to be positioned so that the force applied by the user can be aligned in opposition to the ground reaction force when the snow ski is placed on its inside edge. If opposing ground reaction and applied forces can not be aligned, a moment arm will be created with the effect that the force applied by the user will tend to rotate the foot in the direction of either supination or pronation. The location of the inside edge of a snow ski tends to favour a supination moment arm since the ski edge generally lies medial of the center of the head of the second metatarsal. If the force applied by the user is sufficient in the presence of a moment arm to rotate the foot in the direction of either supination or pronation, the long axis of the tibia will also be caused to rotate through an intrinsic mechanism within the tarsus of the foot. The means to adjust the transverse position of the foot in relation to the inside edge of a snow ski while maintaining the means to independently adjust the position of the foot on the longitudinal axis of the sole of the footwear is important and advantageous to the user and is thus an object of the present invention.

Figure 8:
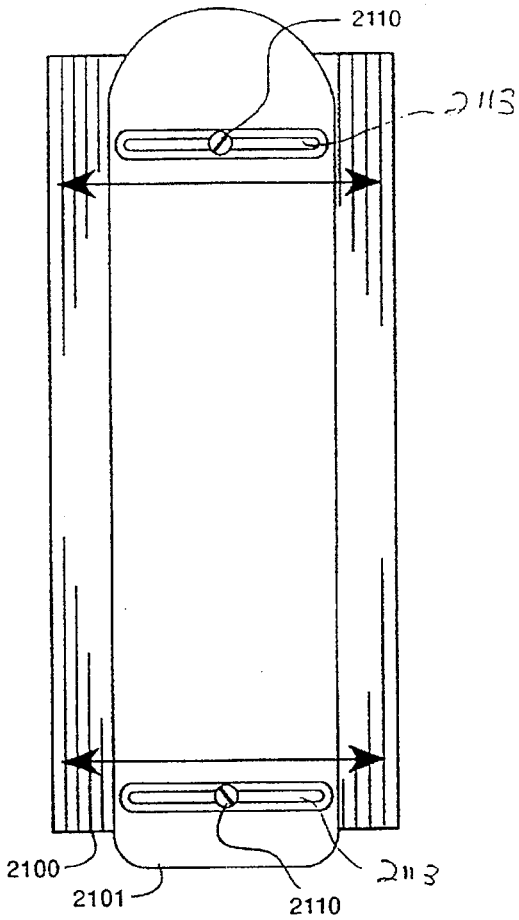
FIG. 8 is an inferior plan view of the rigid base and sports implement interface member of a footwear device according to the invention, showing the facility to shift the transverse position of the interface member in relation to the rigid base.

FIG. 8 shows an inferior plan view of the rigid base 2100 and sole 2101. In this particular embodiment sole 2101 is secured to rigid base 2100 with at least one flat head screw 2110 in a manner which permits sole 2101 to be removed from rigid base 2100. The advantage of such an arrangement is that soles of different specification can be secured to rigid base 2100 in order to meet the particular needs of the user, in this instance, the need to position the foot transversely relative to the appliance affixed to sole 2101.

At least one transverse slot runs inferosuperiorly through sole 2101 which allows the sole to be shifted transversely on rigid base 2100. In the present embodiment two slots 2113, one at each end of the sole 2101, are provided. Flat head screws 2110, at each end of sole 2101, are threaded into rigid base 2100 such that the screws act as studs or guide pins for sole 2101 to move in the slots 2113.

In operation the cohesive tension between sole 2101 and rigid base 2100 is relieved by partially withdrawing the flat head screws 2110 from their receiving threads in rigid base 2100. Sole 2101 can then be shifted medially or laterally within the adjustment range afforded by the slots 2113 until it is located in the desired position. Flat head screws 2110 are then tightened onto their associated threads in rigid base 2100 so as to secure sole 2101 to rigid base 2100 and fix the relationship of the two components.

Figure 9:
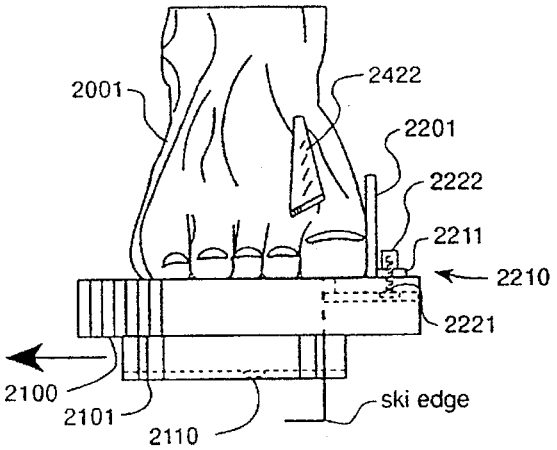
FIG. 9 is an anterior elevation of the rigid base, interface member and medial and superolateral counters of the footwear device of FIG. 8, with the foot of a user positioned thereon, and illustrating the facility to shift the transverse position of the interface member in relation to the rigid base.

FIG. 9 shows an anterior elevation similar to FIG. 6 except that medial forefoot counter 2201 and sole 2101 have been shifted so as to correctly position the narrow foot in relation to the inside edge of a snow ski. Arrows indicate the direction in which the counters have been shifted on rigid base 2100.

Figure 10:
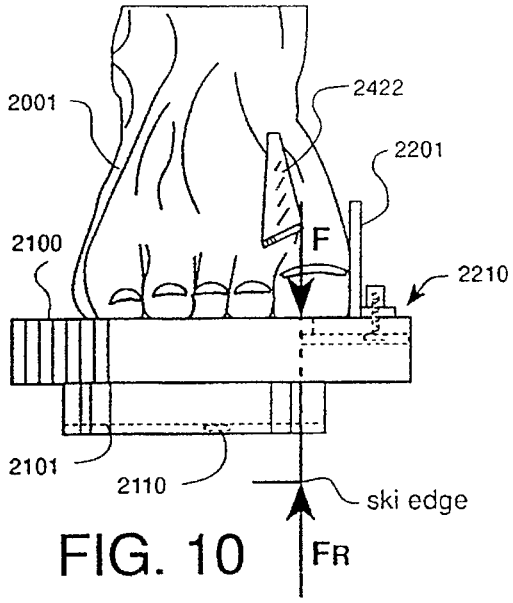
FIG. 10 is an anterior elevation of the rigid base, interface member and medial and superolateral counters of the footwear device of FIG. 8 with the foot of a user in monopedal stance positioned thereon and illustrating the correct transverse position of the force applied to the ski by the foot in relation to the ground reaction force of an edged ski.

FIG. 10 shows substantially the same view as FIG. 9 except that the ground reaction forces FR and the force applied by the user F are shown substantially as they would be when the user us in monopedal stance with the foot correctly positioned in relation to the inside edge of a snow ski affixed to sole 2101.

Figure 11:
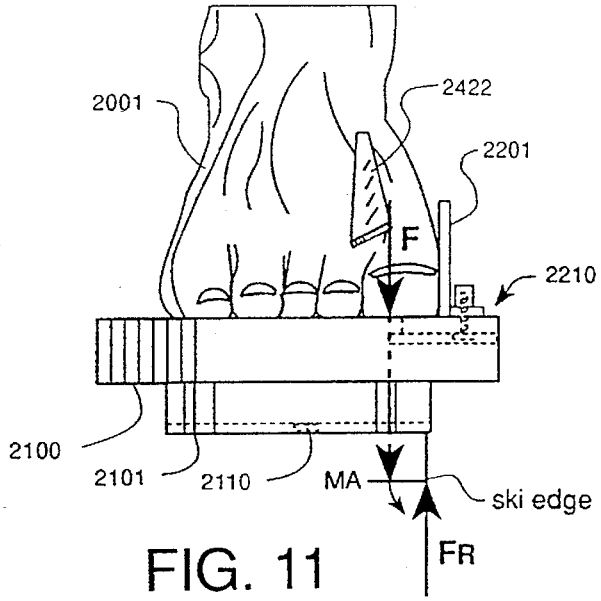
FIG. 11 is an anterior elevation of the rigid base, interface member and medial and superolateral counters of the footwear device of FIG. 8 with the foot of a user in monopedal stance positioned thereon and illustrating the moment arm resulting from the force applied to the ski by the foot acting lateral to the ground reaction force of an edged ski.

FIG. 11 shows substantially the same view as FIG. 10 except that the snow ski shown affixed to sole 2101 is wider on its medial aspect in comparison to the snow ski affixed to sole 2101 as shown in FIG. 10. The position of the inside edge of the snow ski in relation to force F applied by the user is such that the ground reaction force FR and the force F applied by the user are not acting linearly in opposition to each other. The transverse offset between the ground reaction force FR and the force F applied by the user creates a moment arm MA which acts lateral of the ski edge with the result that force F applied by the user acting on the moment arm MA will tend to rotate the foot in the direction of supination when the ski is placed on its inside edge.

Figure 12:
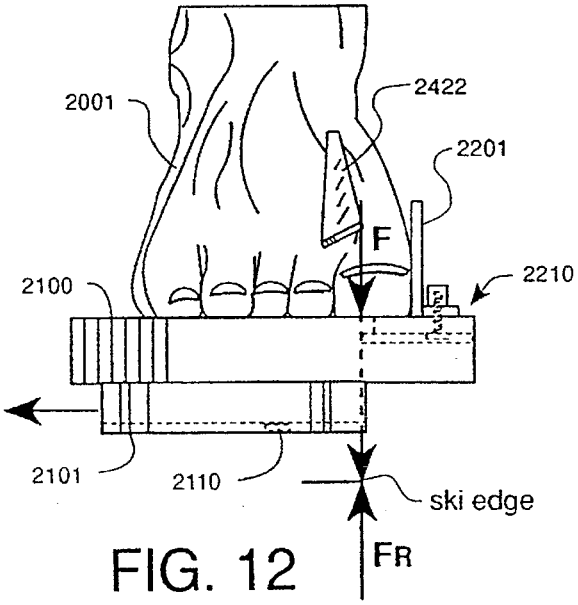
FIG. 12 is an anterior elevation of the rigid base, interface member and medial and superolateral counters of the footwear device of FIG. 8 with the foot of a user in monopedal stance positioned thereon as in FIG. 11 and illustrating how shifting the transverse position of the interface member medially in relation to the rigid base has cancelled the moment arm resulting from the force applied to the ski by the foot being positioned lateral to the ground reaction force of an edged ski as shown in FIG. 11.

FIG. 12 shows substantially the same view as FIG. 11 except that sole 2101 has been shifted laterally in relation to rigid base 2100 so that the ground reaction force FR and the force F applied by the user are now acting linearly in opposition to each other with the result that the moment arm MA as shown in FIG. 11 has been cancelled.

Figure 13:
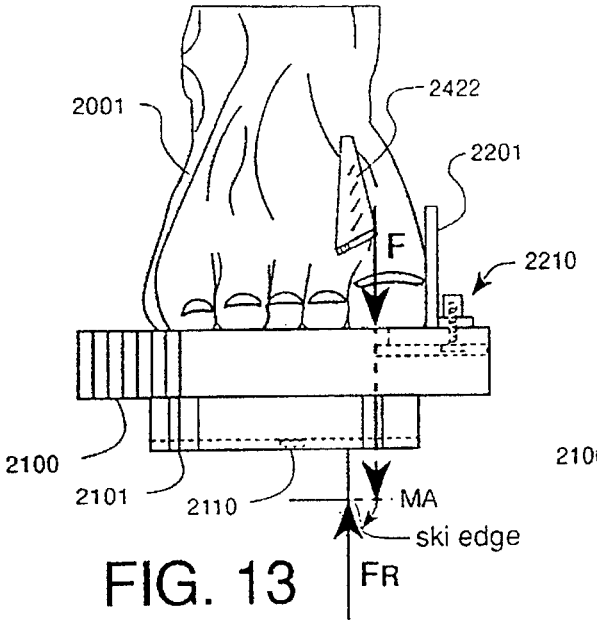
FIG. 13 is an anterior elevation of the rigid base, interface member and medial and superolateral counters of the footwear device with the foot of a user in monopedal stance positioned thereon and illustrating the moment arm resulting from the force applied to the ski by the foot acting medial to the ground reaction force of an edged ski.

FIG. 13 shows substantially the same view as FIG. 10 except that the snow ski affixed to sole 2101 is narrow on its medial aspect in comparison to the snow ski affixed to sole 2101 as shown in FIG. 10. The position of the inside edge of the snow ski in relation to the force F applied by the user is such that the ground reaction force FR and the force F applied by the user are not acting linearly in opposition to each other. The transverse offset between the ground reaction force FR and the force F applied by the user creates a moment arm MA which acts medial of the ski edge with the result that force F applied by the user acting on the moment arm MA will tend to rotate the foot in the direction of pronation when the ski is placed on its inside edge.

Figure 14:
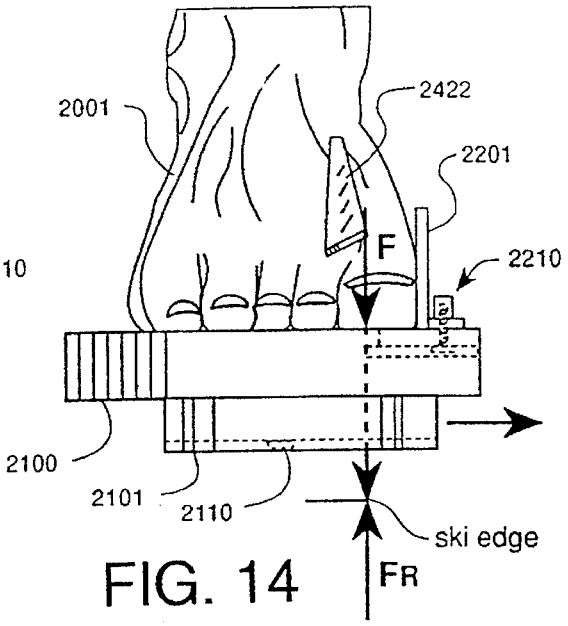
FIG. 14 is an anterior elevation of the rigid base, interface member and medial and superolateral counters of the footwear device of FIG. 8 with the foot of a user in monopedal stance positioned thereon as in FIG. 13 and illustrating how adjusting the transverse position of the sole laterally in relation to the rigid base has cancelled the moment arm resulting from the foot being positioned medial to the ground reaction force of an edged ski as shown in FIG. 13.

FIG. 14 shows substantially the same view as FIG. 13 except that sole 2101 has been shifted medially in relation to rigid base 2100 so that the ground reaction force FR and the force F applied by the user are now acting linearly in opposition to each other with the result that the moment arm MA as shown in FIG. 13 has been cancelled.

Figure 15:
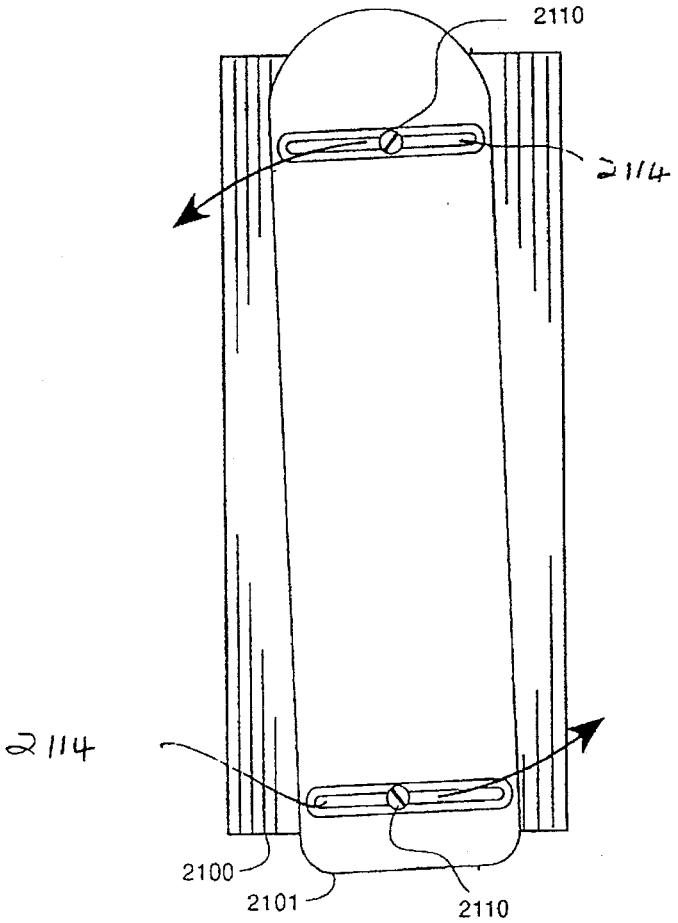
FIG. 15 is an inferior plan view of the rigid base and interface member of the footwear device of FIG. 8 showing the facility to rotate the position of the interface member in relation to the rigid base.

FIG. 15 shows an inferior plan view similar to FIG. 8 where at least one transverse slot is running inferosuperiorly through sole 2101 of sufficient width to permit sole 2101 to be rotated relative to rigid base 2100 about the shank of flat head screw 2110 in addition to the facility to be adjusted transversely as shown in FIG. 8 and in the manner previously described. In the embodiment shown in FIG. 15, two slots 2114 are provided. These facilities are advantageous for aligning the user's foot when skate ice blades, in-line wheel systems, snow skis or the like are mounted to the sole of the footwear.

There are several alternate methods of aligning the foot in relation to the inside edge of a snow ski. For example, a plate or adjustment system which allows the position of the safety binding to be shifted either medially or laterally in relation to the ski in a manner similar to that previously described can be mounted on the top surface of a snow ski. Or, adjustment means can be incorporated into the mounting base of a release binding which allows the binding to be shifted medially or laterally once the base has been mounted to the top of a snow ski. Similar systems which allow the binding to be shifted anteriorly or posteriorly on snow skis presently exist. However, these systems do not anticipate or provide the means for transverse adjustment of the release binding. Yet a further possibility is that binding mounting lugs which permit the release binding to be shifted medially or laterally after it has been mounted to the snow ski can be incorporated within the construction of the snow ski itself.

Figure 16:
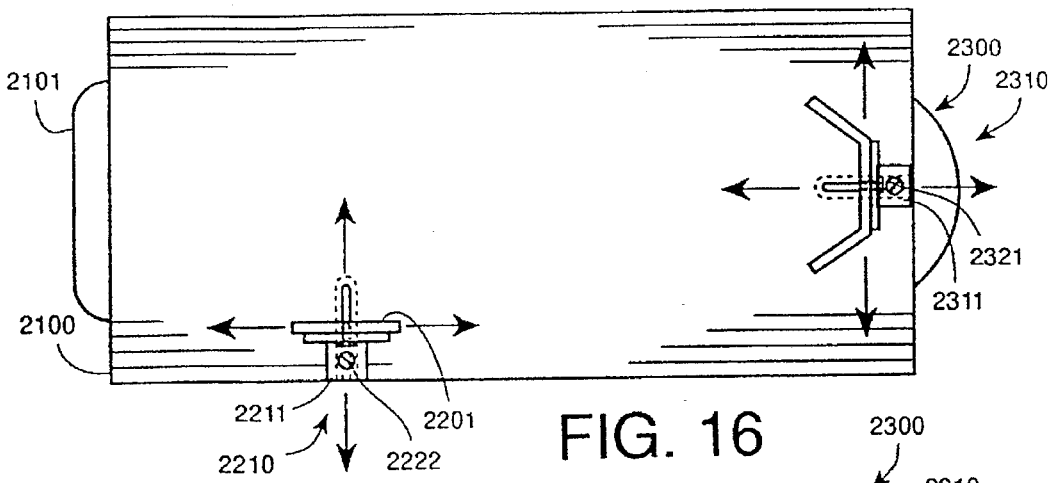
FIG. 16 is a superior plan view of the rigid base of a footwear device according to the invention showing adjustable medial forefoot and heel counters.

FIG. 16 is a superior plan view of rigid base 2100 and sole 2101 with medial forefoot counter 2201 and heel counter 2300 mounted. Other parts of the footwear device 2000 have been omitted for the sake of clarity.

Medial forefoot counter 2201 has been fitted with retention means 2210 whose operation has been previously described. Heel counter 2300 is fitted with retention means 2310 whose operation is substantially the same as retention means 2210. These means provide for adjustment of the position of medial forefoot counter 2201 and heel counter 2300 on rigid base 2100 in the direction indicated by the arrows.

Figure 17:
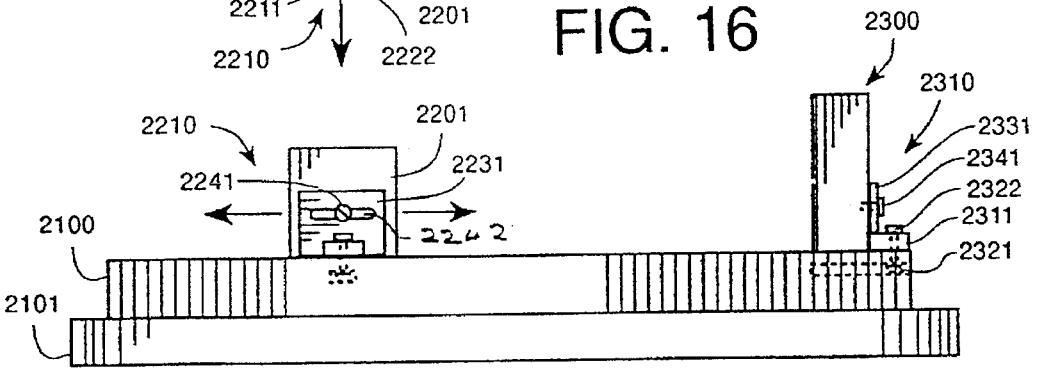
FIG. 17 is a medial elevation of the rigid base of the footwear device of FIG. 16 showing adjustable medial forefoot and heel counters.

FIG. 17 shows a medial elevation of the rigid base 2100 and sole 2101 with medial forefoot counter 2201 and heel counter 2300 as in FIG. 16. Base plate 2211 of medial forefoot counter 2201 has been fitted with a vertical mounting plate 2231. Medial forefoot counter 2201 is mounted to vertical mounting plate 2231 by flat head screw 2241 which passes through an oblong slot 2242 in vertical mounting plate 2231 and screws into a threaded hole in the medial face of medial forefoot counter 2201. In this configuration, the arrangement of medial forefoot counter with retention means 2210 is such that medial forefoot counter 2201 can be removed from retention means 2210 and replaced with a medial forefoot counter of different specification.

When mounted to the vertical mounting plate 2231 of retention means 2210, medial forefoot counter 2201 can be shifted anteriorly or posteriorly in addition to the facility to shift the counter medially or laterally previously described. In operation, tension is backed off flat head screw 2241 and medial forefoot counter 2201 is shifted either anteriorly or posteriorly within the limit of adjustment of the slot 2242. The shank of flat head screw 2241 travels in the oblong slot 2242 provided in vertical mounting plate 2231. When the desired position of medial forefoot counter is established flat head screw 2241 is tightened against the receiving threads in medial forefoot counter 2201 so as to secure and fix the position of the medial forefoot counter 2201 on vertical mounting plate 2231.

In a similar fashion to medial forefoot counter 2201, heel counter 2300 is fitted with base plate 2311 which allows heel counter 2300 to be affixed to the superior surface of rigid base 2100 by retention means 2310. Inverted threaded flat head screw 2321 can move within a slot 2323 formed in the side of rigid base 2100 and which extends posteroanteriorly in the interior of rigid base 2100. The adjustment slot 2323 in which inverted flat head screw 2321 can move within rigid base 2100 is shown with dashed lines as is flat head screw 2321.

The threaded portion of flat head screw 2321 extends superiorly through the superior surface of rigid base 2100 and continues through a receiving hole in base plate 22311. Threaded cap 2322 threads onto the receiving threads of flat head screw 2321 such that retention means 2310 secures and fixes the location of heel counter 2300 on rigid base 2100 when threaded cap 2322 is tensioned against flat head screw 2321.

When tension is released on base plate 2311 by backing off threaded cap 2322, retention means 2310, along with heel counter 2301, can be shifted anteriorly or posteriorly on rigid base 2100 to the desired location within the range of adjustment in the slot 2323. The advantage of such an arrangement being that heel counter 2300 is now independent of rigid base 2100. It can thus be removed and replaced with a heel counter of different specification or adjustments can be made to the counter's position on rigid base 2100.

Figure 19:
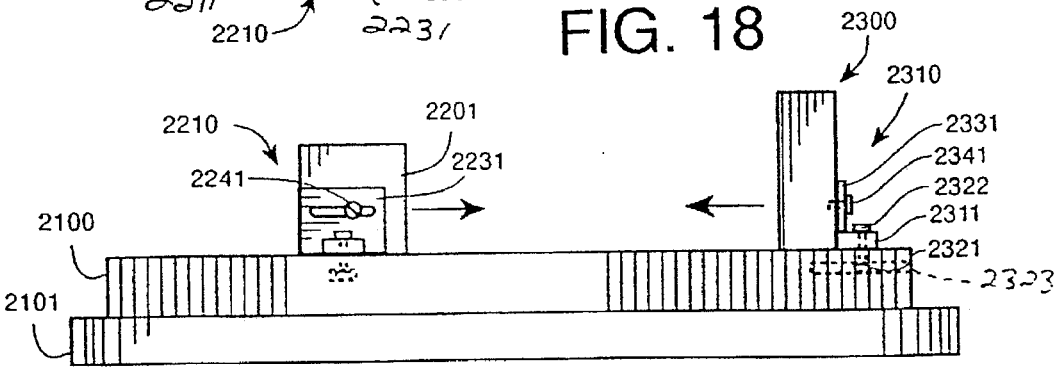
FIG. 19 is a medial elevation of the elements shown in FIG. 18.

The retention means 2310 further includes a vertical member 2331 connected at right angles to the base plate 2311. The member 2331 is provided with a horizontal slot (not shown) through which an adjustment screw 2341 extends which screws into the heel counter 2300, as shown in FIG. 19. Thus, by loosening the screw 2341, the heel counter 2300 can be adjusted medially/laterally with respect to the foot along the horizontal slot.

Figure 18:
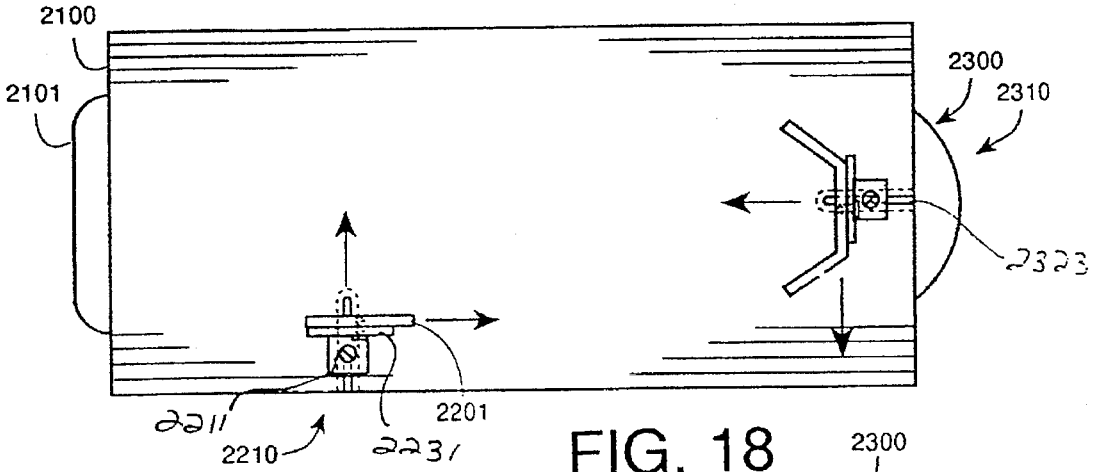
FIG. 18 is a superior plan view similar to FIG. 16 showing the adjustable medial forefoot and heel counters and indicating the direction the counters have been shifted on the rigid base relative to FIG. 16.

FIG. 18 is similar to FIG. 16 except that medial forefoot counter 2210 and heel counter 2300 have been repositioned on rigid base 2100 in the directions indicated by the arrows. Medial forefoot counter 2201 has been shifted laterally and posteriorly. Heel counter 2300 has been shifted anteriorly and medially.

FIG. 19 is similar to FIG. 17 except that medial forefoot counter 2201 and heel counter 2300 have been shifted on rigid base 2100 as shown in FIG. 18. Arrows indicate the posterior shift of medial forefoot counter 2201 and the anterior shift of heel counter 2300.

Figure 20:
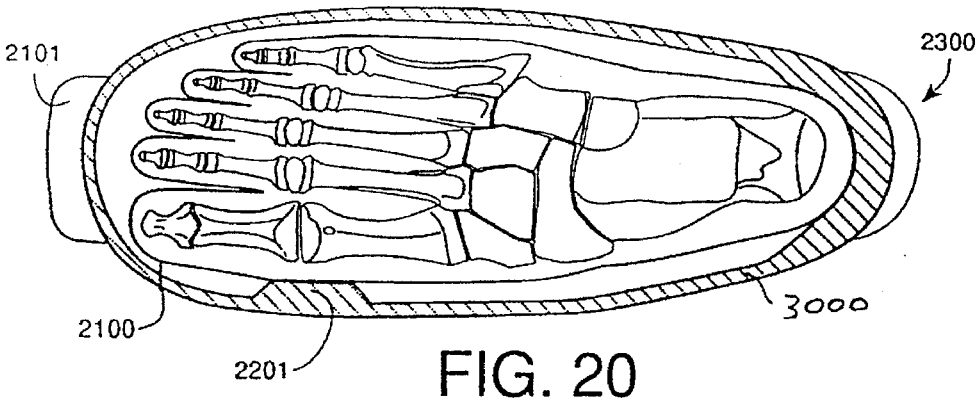
FIG. 20 is a superior plan view of the rigid base of a footwear device according to the invention showing a cutaway portion of the lower outer shell of the footwear device with medial forefoot and heel counters incorporated into the molding of the outer shell.

FIG. 20 shows a superior plan view of the lower outer shell component 3000, rigid base 2100 and sole 2101 of a ski boot. The lower outer shell has been cut horizontally just above the top of heel counter 2300 so as to expose rigid base 2100. Medial forefoot counter 2201 and heel counter 2300 have been incorporated into the shape of outer lower shell component 3000 in a manner which provides for the necessary operating clearance between the counters for the changing form or architecture of the foot when moving between bipedal and monopedal stances.

While the incorporation of medial forefoot counter 2201 and heel counter 2300 into outer lower shell component 3000 shown in FIG. 20 is advantageous so far as economy of production, it does not provide for adjustment of the counters as previously described. Contact of discrete aspects of the user's foot with the appropriate structures of footwear device 2000 is important to the correct operation of the device.

Figure 21:
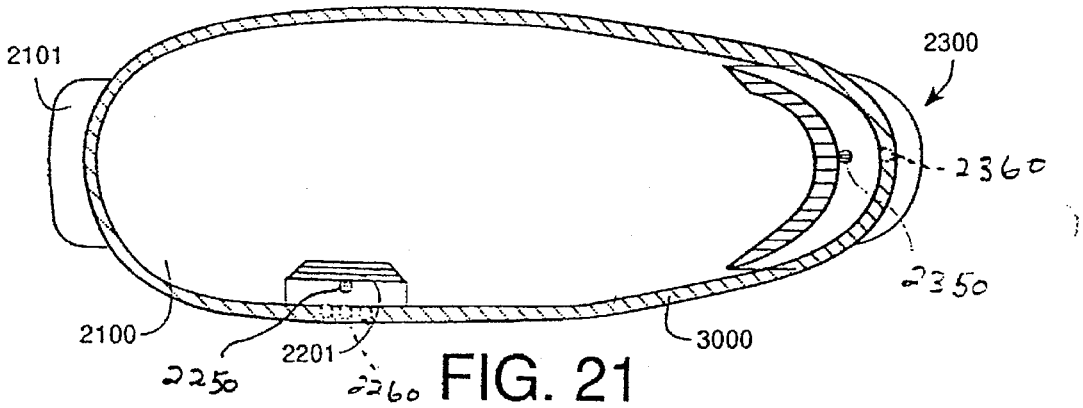
FIG. 21 is a superior plan view of the rigid base of a footwear device according to the invention showing a cutaway portion of the lower outer shell of the footwear device and showing separate medial forefoot and heel counters for attachment to the shell.

FIG. 21 shows the same view as FIG. 20 except that medial forefoot counter 2201 and heel counter 2300 are separate structures and thus independent from outer lower shell component 3000. The counters are shown ready to be attached to the wall of lower outer shell component 3000. The counters snap into place by way of production lugs 2250, 2350 molded onto the counter surface which contacts the inner surface of outer lower shell component 3000. Receiving holes 2260, 2360 for the production lugs are molded into the appropriate location of the wall of outer lower shell component 3000. Receiving holes can also be provided in rigid base 2100. The advantage of such an arrangement is that medial forefoot counter 2201 and heel counter 2300 can be removed from outer lower shell component 3000 and replaced with counters of a different specification.

Figure 22:
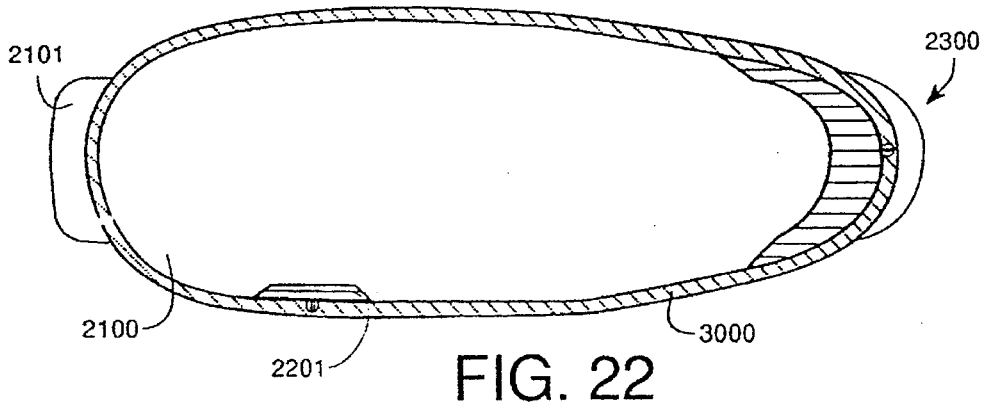
FIG. 22 is a superior plan view similar to FIG. 21 showing medial forefoot and heel counters attached which are of a different specification than those shown in FIG. 21.

FIG. 22 is similar to FIG. 21 except that medial forefoot counter 2201 and heel counter 2300 are of a different specification than those shown in FIG. 21. Multiple receiving holes 2250 are provided for medial forefoot counter 2201 to enable the counter to be shifted anteriorly or posteriorly in relation to rigid base 2100. Heel counter 2300 has the effect of shifting the foot of the user anteriorly while the medial face of medial forefoot counter 2201 is thinner mediolaterally than the equivalent counter as shown in FIG. 20. The effect is that the lateral face of medial forefoot counter 2201 has shifted medially. By utilizing counters of other specification, the foot can be positioned on rigid base 2100 in a similar manner to the means previously described to adjust medial forefoot counter 2201 and heel counter 2300.

Figure 23:
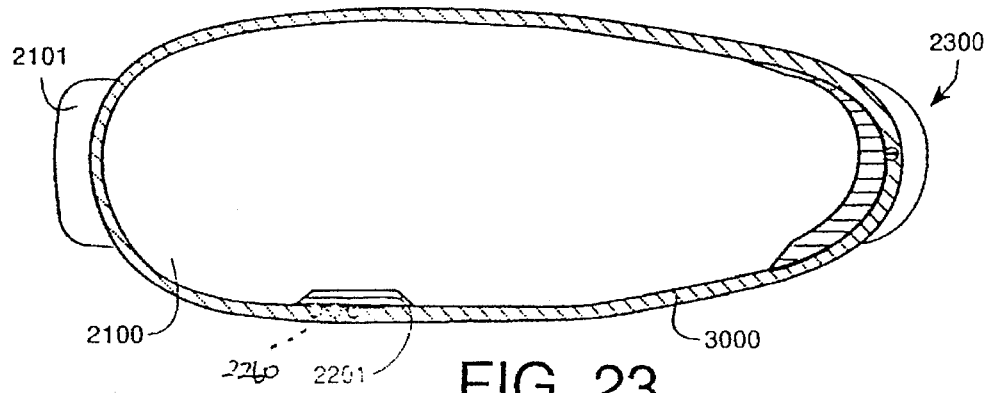
FIG. 23 is a superior plan view similar to FIG. 22 showing separate medial forefoot and heel counters attached which are of a different specification than those shown in FIG. 22.

FIG. 23 is similar to FIG. 22 except that heel counter 2300 is now thinner on its lateral face and wider on its medial face with the result that the foot of a user is offset laterally on rigid base 2100. Medial forefoot counter 2201 is the same form as that of FIG. 22 except that the counter has been inserted to the most posterior mounting hole in the wall of lower outer shell component 3000.

There are several advantages to footwear employing either removable or adjustable medial forefoot and heel counters or counters which affix to the outer shell of the footwear. Outer shell components can be satisfactorily used for a broad range of foot sizes because the structure of the outer shell component can be extended so as to contact discrete areas of the foot in a manner which maintains the correct position of the user's foot on the rigid base of the footwear.

A further advantage is that removable modular counters can be designed in conjunction with the outer shell components so the same counters can be utilized in both left and right shell components thereby halving production costs. In the case of asymmetrical heel counters intended to offset the heel of the user either medially or laterally in order to effect the correct position on the rigid base the asymmetrical heel counters can be interchanged between left and right outer shell components so as to reverse the offset.

The compression and decompression of the arch of the foot which occur when the user moves between bipedal and monopedal stances is accommodated by the pivoting of instep counter 2420 about its horizontal pivot axis on pivot 2430. Under normal operating conditions, the foot can be maintained in good contact with the rigid base 2100 and the heel counter 2300. However, under high loads imposed by the activity of the elite skier, the instep counter 2420 may have to be secured in contact with the dorsum of the foot with proportionally higher force in order to maintain the same level of connection enjoyed by the less demanding skier. While the level of comfort may still be regarded as good, the object of footwear device 2000 is to maximize user comfort by minimizing as much as possible, the application of force to the foot and leg.

When forces act on the user, in particular, inferoanteriorly acting forces, which tend to cause a reduction in the force applied to rigid base 2100 by the foot, compression of the soft tissue of the dorsum of the foot and/or compression of any surface treatment of instep counter 2420 may occur as the force applied to instep counter 2420 by the dorsum of the foot increases. Compression of these materials may allow instep counter 2420 to be levered upward at its posterior aspect with resultant reduction of the contact area of the heel with the rigid base 2100.

Although less likely, a similar situation may arise where the skier encounters a sudden anteroposteriorly acting resistance or a force which tends to cause the foot to move anteriorly on rigid base 2100. Levering of instep counter 2420 at its limits of bipedal and monopedal stance can be significantly reduced without the necessity of applying high force to the dorsum of the foot by fitting at least one stop means to pivot 2430 to arrest the pivoting of instep counter 2420 at the limits of either bipedal and/or monopedal stances.

Figure 24:
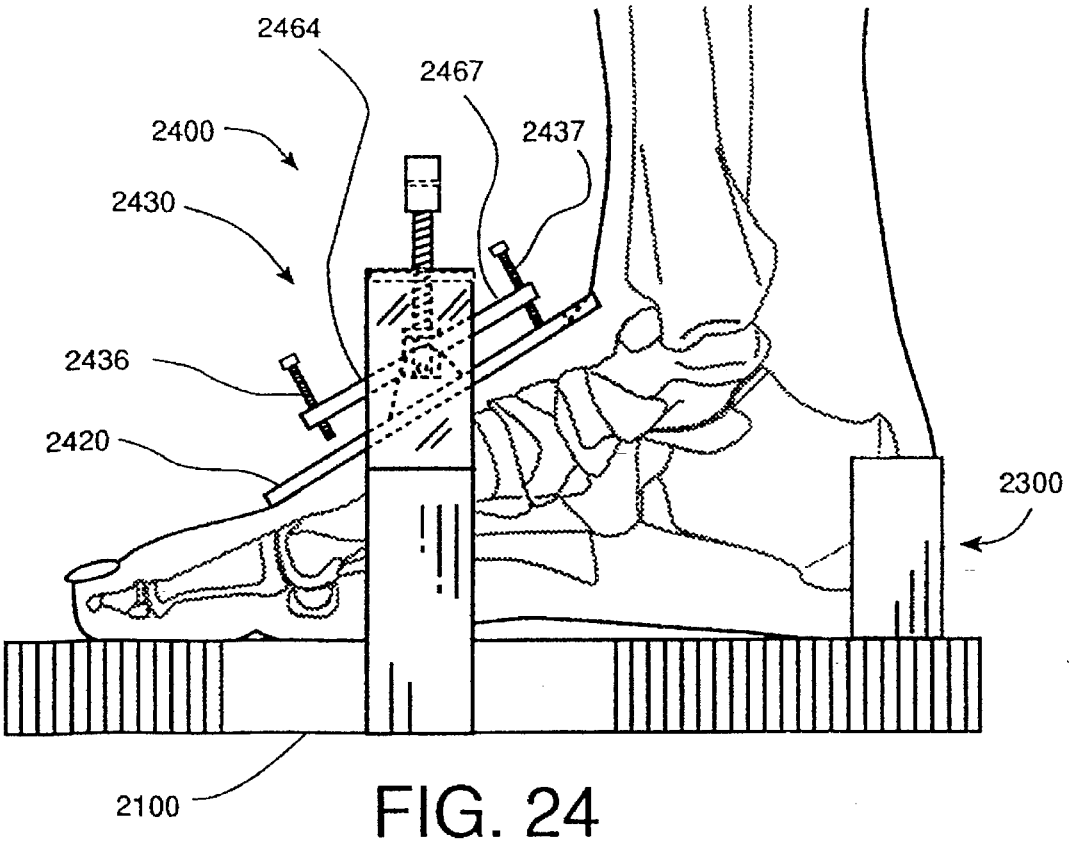
FIG. 24 is a medial elevation of the rigid base, heel counter and a pivotable support of a footwear device according to the invention, showing the addition of a stop means to the instep counter pivot.

FIG. 24 shows a medial elevation of the right foot of a user in bipedal stance positioned on rigid base 2100. Rigid base 2100, heel counter 2300 and forefoot/midfoot pivotal support 2400 are shown. Other elements of the footwear device 2000 have been omitted for the sake of clarity.

The connector link 2434 of pivot 2430 has been fitted with arms 2464, 2467 extending anteriorly and posteriorly above instep counter 2420. The posterior arm has a threaded hole to receive an adjustable posterior stop screw 2437. The anterior arm has a threaded hole to receive an adjustable anterior stop screw 2436.

In FIG. 24, posterior stop 2437 is in contact with the posterior superior aspect of instep counter 2420 as the foot of the user is in the architecture associated with bipedal stance. For the same reason, anterior stop 2436 has clearance between its inferior end and the anterior superior aspect of instep counter 2420 to permit sufficient rotation of instep counter 2420 about its axis with pivot 2430 to allow the user to assume a position of monopedal stance.

Figure 25:
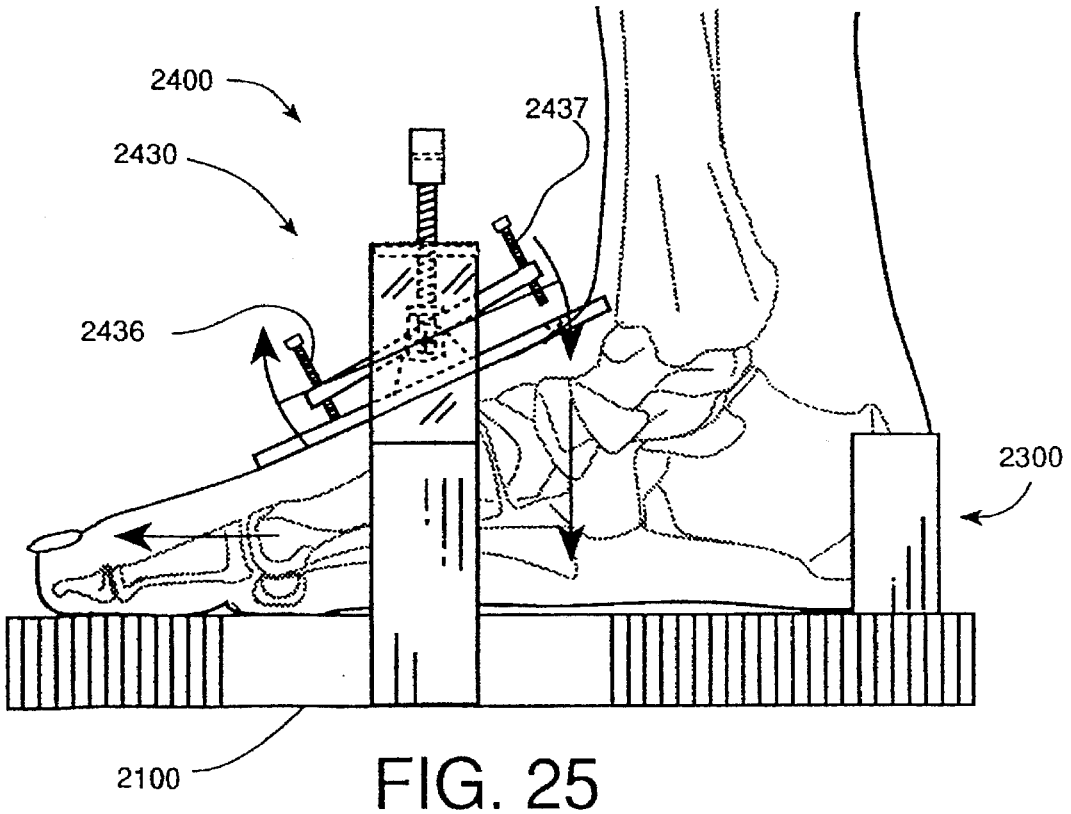
FIG. 25 is a view similar to FIG. 24, showing the operation of the stop means.

FIG. 25 is a view similar to FIG. 24 with the same elements shown. In this figure, the foot of the user is shown in monopedal stance. Counter stop 2436 is now in contact with the anterior superior aspect of instep counter 2420 due to the rotation which has taken place about its axis with pivot 2430. For the same reason, counter stop 2437 now has clearance between its inferior end and the posterior superior aspect of instep counter 2420 sufficient to permit the user to assume a position of bipedal stance.

In operation counter stops 2436 and 2437 will initially be backed off to ensure instep counter 2420 has adequate rotation about its axis with pivot 2430 to permit the counter to assume the angle of the dorsum of the user's foot and for the user to assume both bipedal and monopedal stances.

Instep counter 2420 is first adjusted as previously described with the foot of the user in bipedal stance. Counter stop 2437 is now adjusted so as to contact instep counter 2420.

Once counter stop 2437 has been adjusted, the user should assume a position of monopedal stance. Counter stop 2436 is then adjusted so as to contact instep counter 2420. Further adjustment may be required once the user has engaged in the skiing activity. If desired, counter stop 2436 may be omitted, the stop 2437 on posterior arm 2467 being the more important one.

Instep counter 2420, as previously described, consists of a number of plates or planes oriented so as to direct force to specific areas of the dorsum of the foot of the user. Instep counter 2420 acts in concert with the foot of the user and heel counter 2300 and medial forefoot counter 2201 both of which are mounted to rigid base 2100 in this embodiment.

While the previously disclosed structure of instep counter 2420 are effective in maintaining the application of force to the dorsum of the first metatarsal and midfoot and the superolateral and medial aspects of the first metatarsal when moving between bipedal and monopedal stances, these structures do not provide for continuous contact with the superolateral and superomedial aspects of the midfoot when moving between bipedal and monopedal stances since such contact would interfere with the inferomedial movement of this aspect of the foot. The structures of the following embodiments overcome this limitation and allow for continuous superolateral and superomedial or medial contact of the midfoot when moving between bipedal and monopedal stances.

Figure 26:
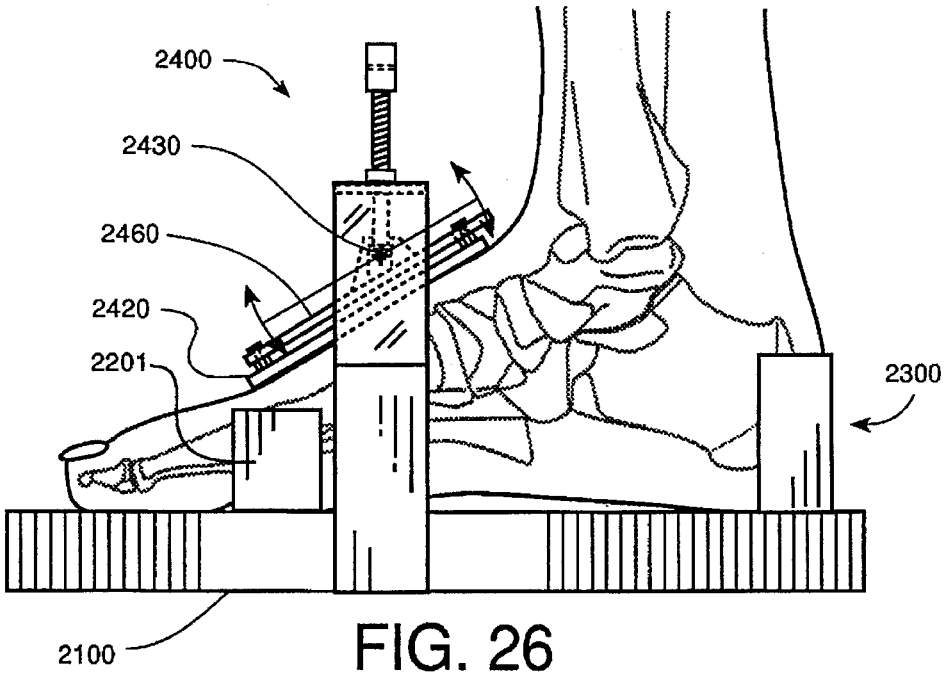
FIG. 26 is a medial elevation of the rigid base, medial forefoot counter, heel counter and midfoot/forefoot pivotal support of a footwear device according to the invention, showing an instep counter which is connected to an instep counter carriage.

Another embodiment is shown in FIG. 26, which shows a medial view of rigid base 2100, medial forefoot counter 2201, heel counter 2300 and forefoot/midfoot pivotal support 2430 with instep counter 2420 mounted thereon. The right foot 2001 of a user is positioned on rigid base 2100. Other elements of the footwear device 2000 have been omitted for the sake of clarity. In this particular embodiment, instep counter 2420 is mounted to an instep counter carriage 2460 in a manner which allows it to rotate about a vertical axis 2470 substantially centered over the medial/lateral axis of the head of the first metatarsal. Instep counter carriage 2460 is mounted to pivot 2430.

Figure 27:
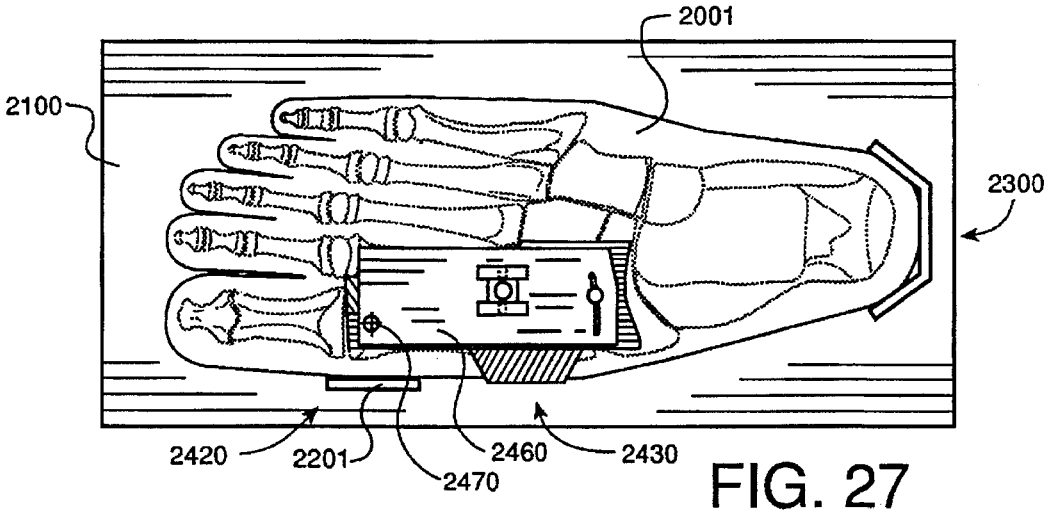
FIG. 27 is a superior plan view of the rigid base, medial forefoot counter, heel counter, instep counter and instep counter carriage of FIG. 26.

FIG. 27 shows the same structure as FIG. 26 in a superior plan view except that rigid arch 2410 of forefoot/midfoot compression member 2400 has been omitted for the sake of clarity.

Figure 28:
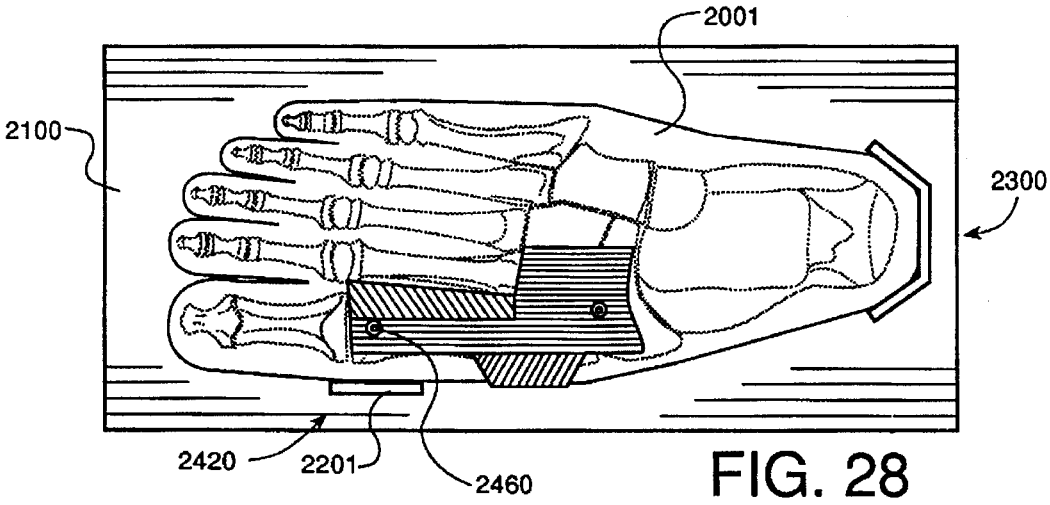
FIG. 28 is a superior plan view of the rigid base, medial forefoot counter, heel counter and instep counter of FIG. 26.

FIG. 28 shows the same structure as FIG. 27 except that instep counter carriage 2460 has been omitted to show the structure of instep counter 2420.

Figure 29:
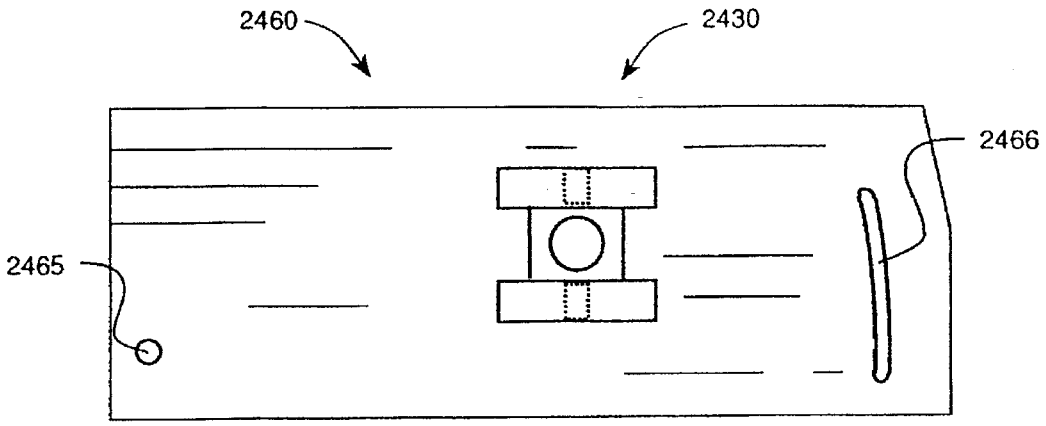
FIG. 29 is a superior plan view of the instep counter carriage of FIG. 26.

FIG. 29 is a superior plan view of instep counter carriage 2460 with pivot 2430 mounted. A hole 2465 at the anteromedial aspect of instep counter carriage 2460 is provided so that an axis pin 2461 on instep counter 2420 can be inserted through the hole in a manner which allows instep counter 2420 to rotate about instep counter carriage 2460 about the vertical axis 2470. A slot 2466 at the posterior end of instep counter carriage 2460 is provided to allow a guide stud 2462 mounted on instep counter 2420 to extend through the slot 2466 and guide instep counter 2420 as it rotates about axis pin 2461, which coincides with the pivotal axis 2470.

Figure 30:
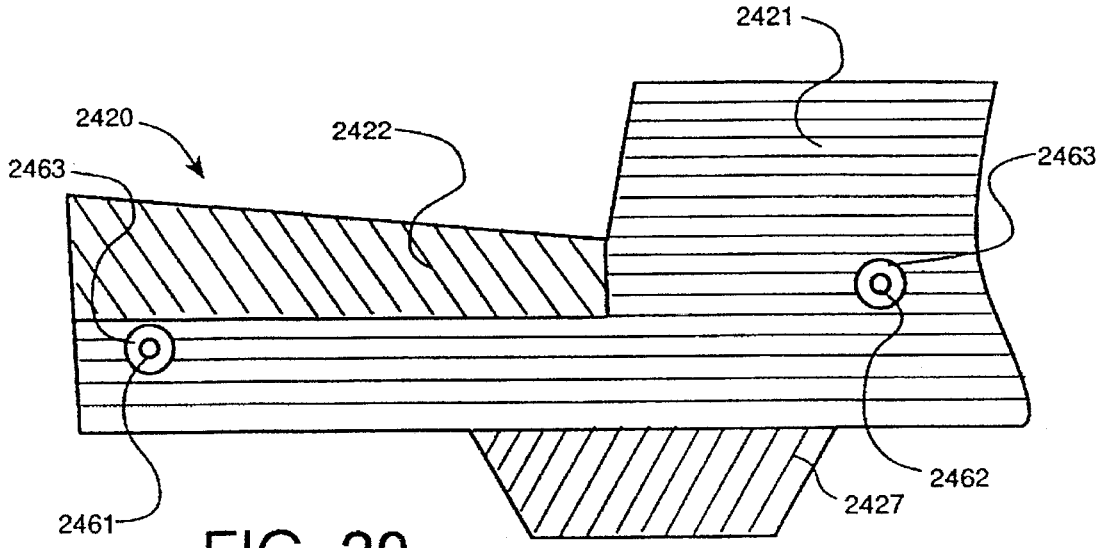
FIG. 30 is a superior plan view of the instep counter of FIG. 26.

FIG. 30 shows a superior plan view of instep counter 2420. Axis pin 2461 is shown mounted on anteromedial aspect of instep counter 2420. Guide stud 2462 is shown mounted on the posterior aspect of instep counter 2420. Washers 2463 (typical) are set at the base of axis pin 2461 and guide stud 2462 where they serve as spacers to control the contact area between instep counter 2420 and instep counter carriage 2460.

Figure 31:
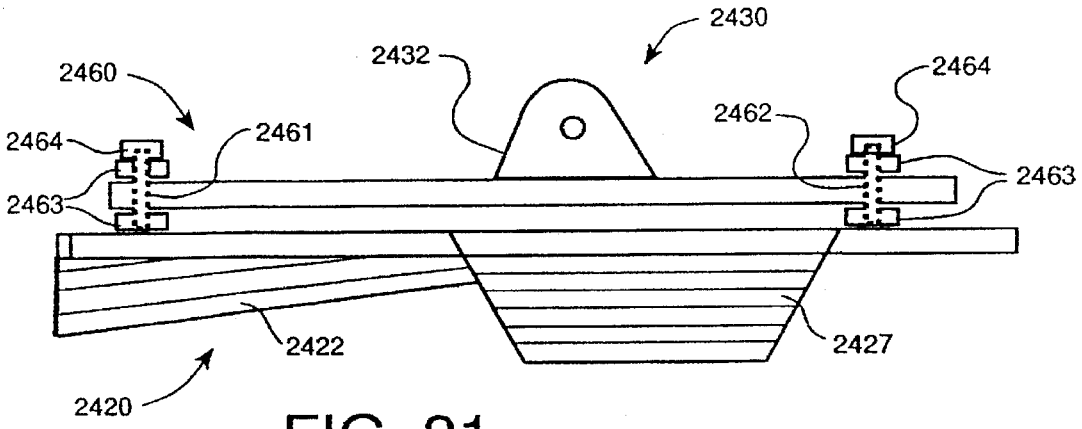
FIG. 31 is a medial elevation of the instep counter and instep counter carriage of FIG. 26.

FIG. 31 shows a medial elevation of instep counter 2420 and instep counter carriage 2460 with pivot amount 2432 shown mounted to instep counter carriage 2460. Axis pin 2461 and guide stud 2462 are shown with washers 2463 (typical) set at the base of the axis pin 2461 and guide stud 2462 and on top of instep counter 2420 in each instance. Axis pin 2461 and guide stud 2462 are each fitted with a keeper 2464 (typical) which maintains instep counter carriage 2460 in its relationship with instep counter 2420.

Figure 32:
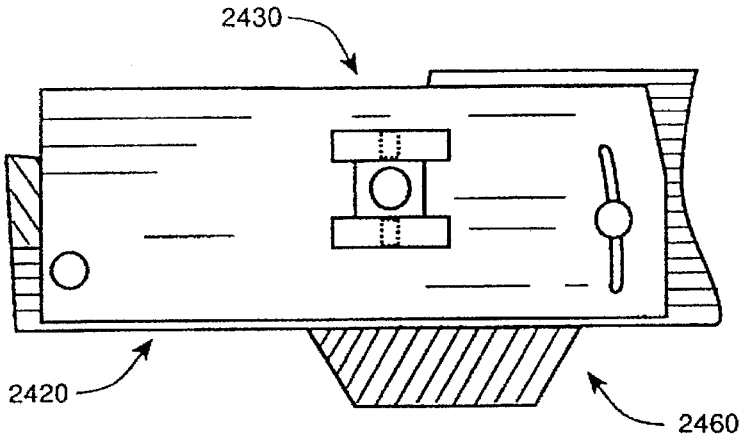
FIG. 32 is a superior plan view of the instep counter carriage and instep counter of FIG. 26 showing the instep counter centered on the instep counter carriage.

FIG. 32 is a superior plan view of instep counter carriage 2460, instep counter 2420 and pivot 2430 showing instep counter 2420 aligned longitudinally with instep counter carriage 2460.

Figure 33:
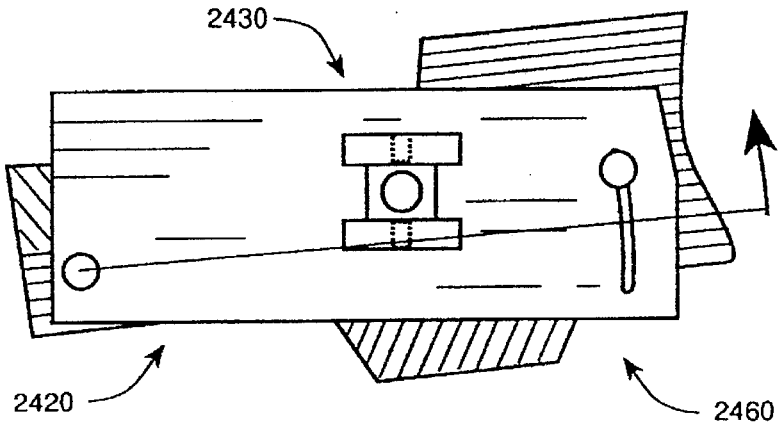
FIG. 33 is a superior plan view of the instep counter carriage and instep counter of FIG. 26 showing the instep counter rotated laterally on the instep counter carriage.

FIG. 33 is a superior plan view of instep counter carriage 2460, instep counter 2420 and pivot 2430 showing instep counter 2420 rotated laterally about its axis with instep counter carriage 2460.

Figure 34:
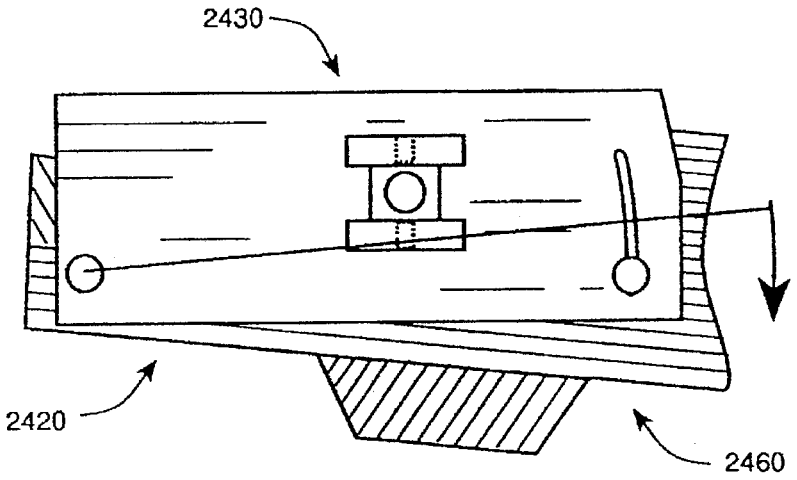
FIG. 34 is a superior plan view of the instep counter carriage and instep counter of FIG. 26 showing the instep counter rotated medially on the instep counter carriage.

FIG. 34 is a superior plan view of instep counter carriage 2460, instep counter 2420 and pivot 2430 showing instep counter 2420 rotated medially about its axis with instep counter carriage 2460.

In combination with pivot 2430 which accommodates inferior/superior movements of the midfoot and instep counter carriage 2460 which accommodates medial/lateral movements of the midfoot, instep counter 2420 is able to maintain contact with the dorsum of the foot during the inferomedial and superolateral movement of the midfoot which occurs when moving between bipedal and monopedal stances. the facility for instep counter 2420 to simultaneously pivot on two axes makes possible new arrangements of counter plates or planes.

The operation of forefoot/midfoot compression member 2400 with instep counter carriage 2460 incorporated is essentially the same as previously described except that the longitudinal axis of counter carriage 2460 should be aligned with the longitudinal axis of rigid base 2100 when securing the position of instep counter 2420 on arch 2410.

There are several advantages afforded by the use of instep counter carriage 2460 in conjunction with pivot 2430 on instep counter 2420. Instep counter carriage 2460 allows the structure of instep counter 2420 to apply force to the dorsum of the foot including its superolateral and superomedial or medial aspects while accommodating the displacement of elements of the foot associated with movement between bipedal and monopedal stances. Instep counter carriage 2460 also enables instep counter 2420 to seek the medial/lateral center of the midfoot of the user which can be slightly different between users. This facility is advantageous because it allows for the more or less automatic adjustment of the instep counter to this aspect of the foot.

Figure 35:
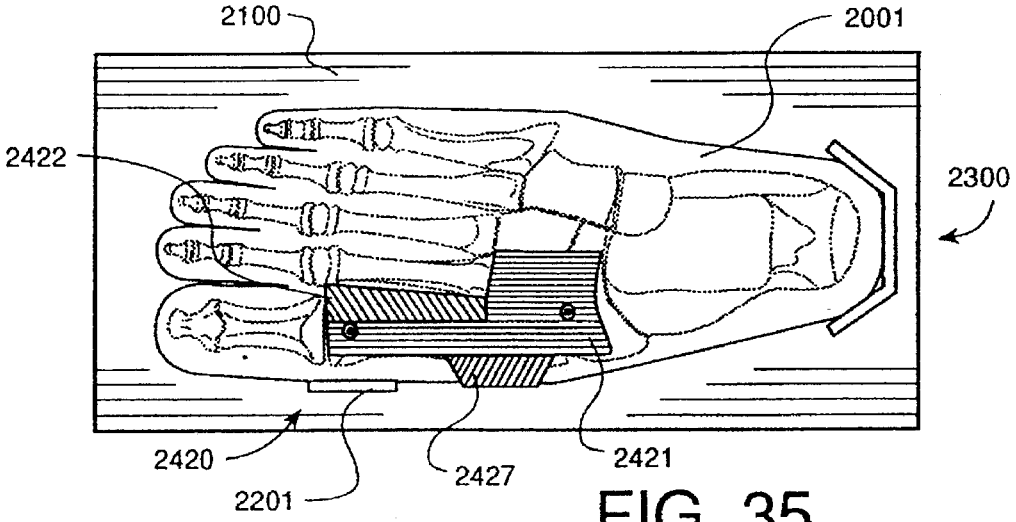
FIGS. 35, 36, 37, 38, 39, 40, 41, and 42 are superior plan views of the rigid base of a footwear device, showing different combinations of counters.

FIG. 35 is a superior plan view of rigid base 2100, medial forefoot counter 2201 and instep counter 2420. Other elements of the footwear device 2000 have been omitted for the sake of clarity.

In this particular embodiment of instep counter 2420, the counter comprises three plates or planes: dorsum first metatarsal/dorsum midfoot counter 2421, superolateral first metatarsal counter 2422 and superolateral midfoot counter 2427, all of which are intended to provide substantially continuous contact with the associated aspect of the dorsum of the foot.

Figure 36:
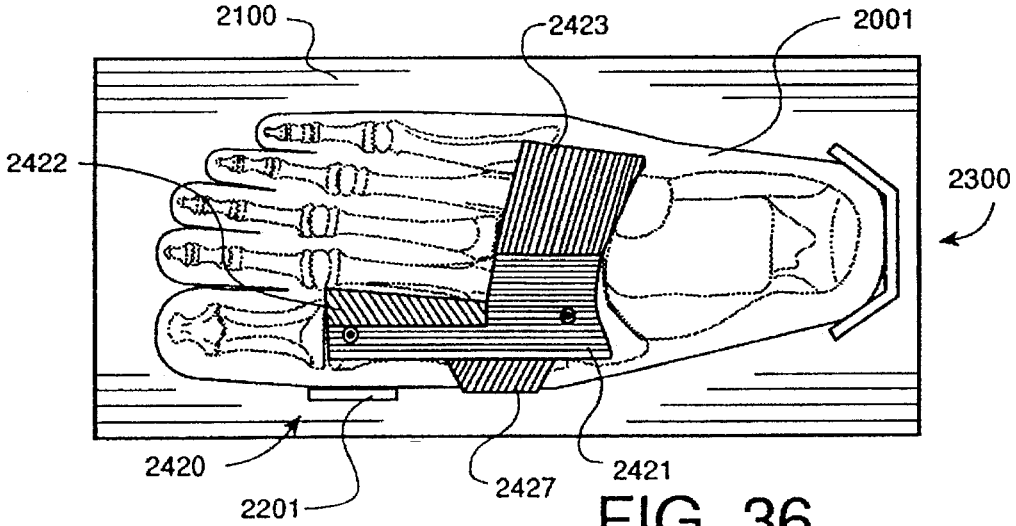

FIG. 36 is the same view as shown in FIG. 35 except that superolateral midfoot counter 2423 has been added to instep counter 2420.

Figure 37:
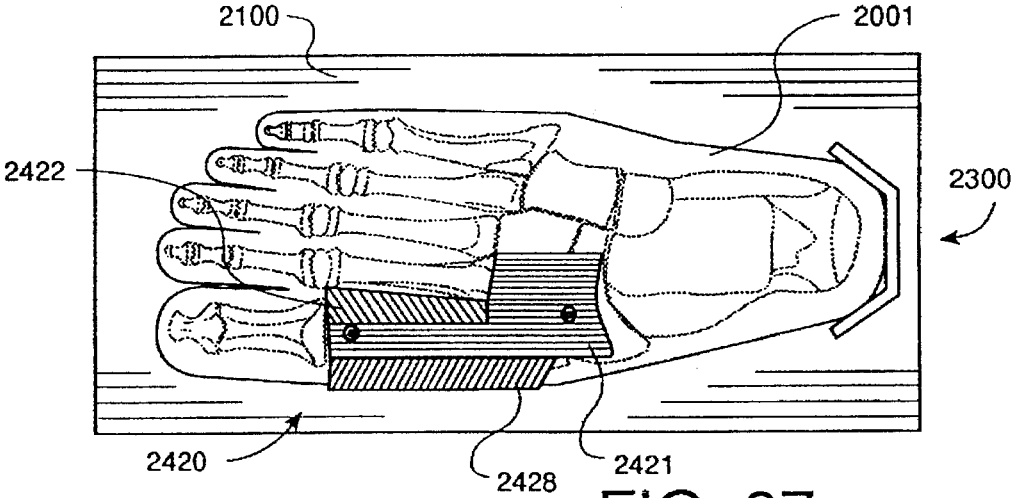

FIG. 37 is the same view as shown in FIG. 35 except that medial forefoot counter 2201 has been replaced by superomedial counter 2428 which is located on instep counter 2420.

Figure 38:
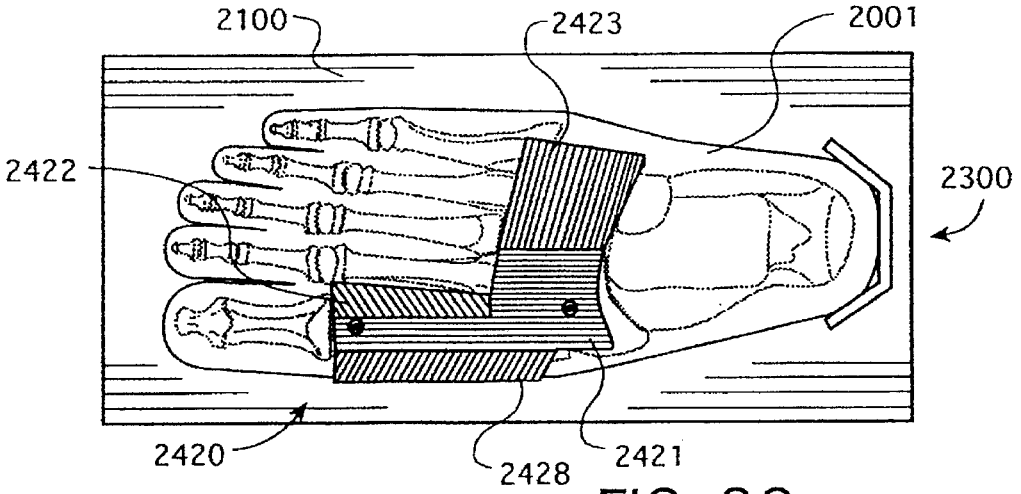

FIG. 38 is the same view as shown in FIG. 37 except that superolateral midfoot counter 2423 has been added to instep counter 2420.

Figure 39:
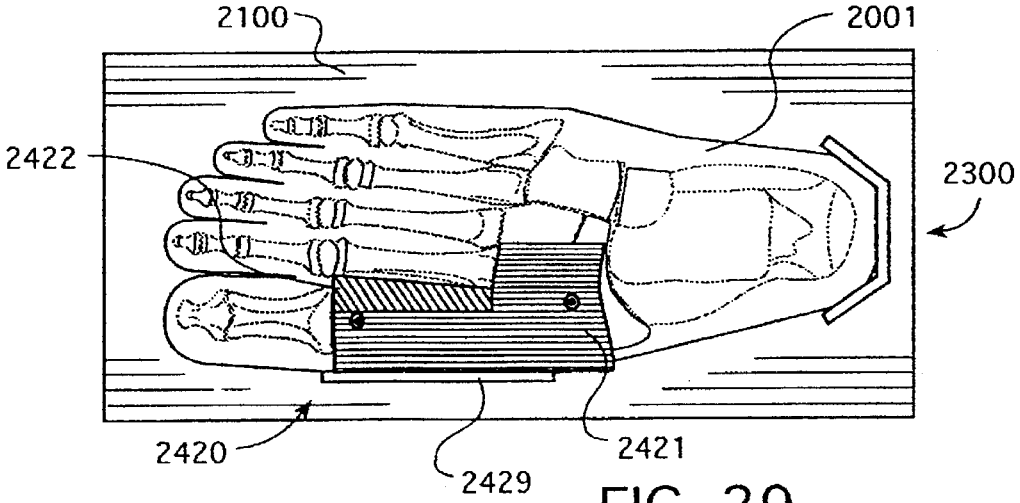

FIG. 39 is similar to FIG. 37 except that superomedial counter 2428 has been replaced by medial counter 2429.

Figure 40:
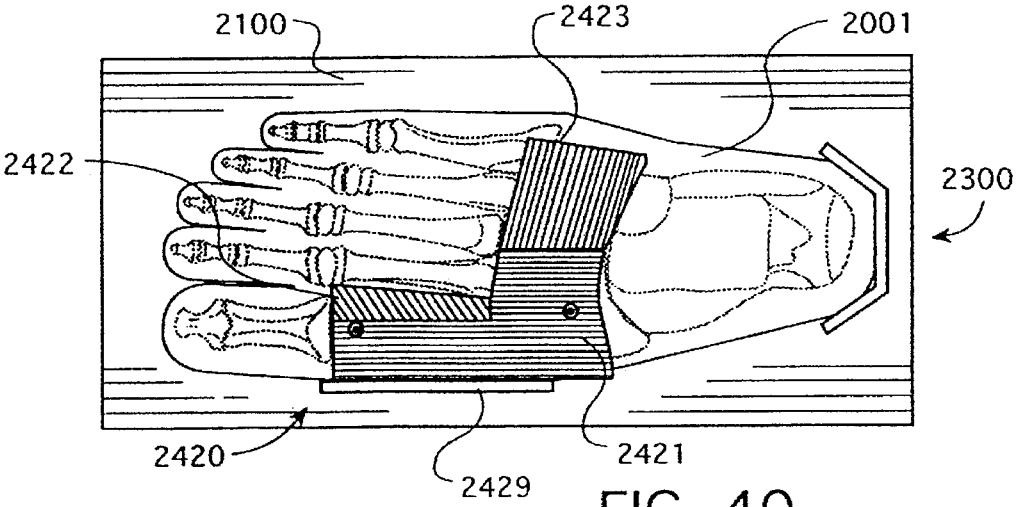

FIG. 40 is the same view as shown in FIG. 39 except that superolateral midfoot counter 2423 has been added to instep counter 2420.

Figure 41:
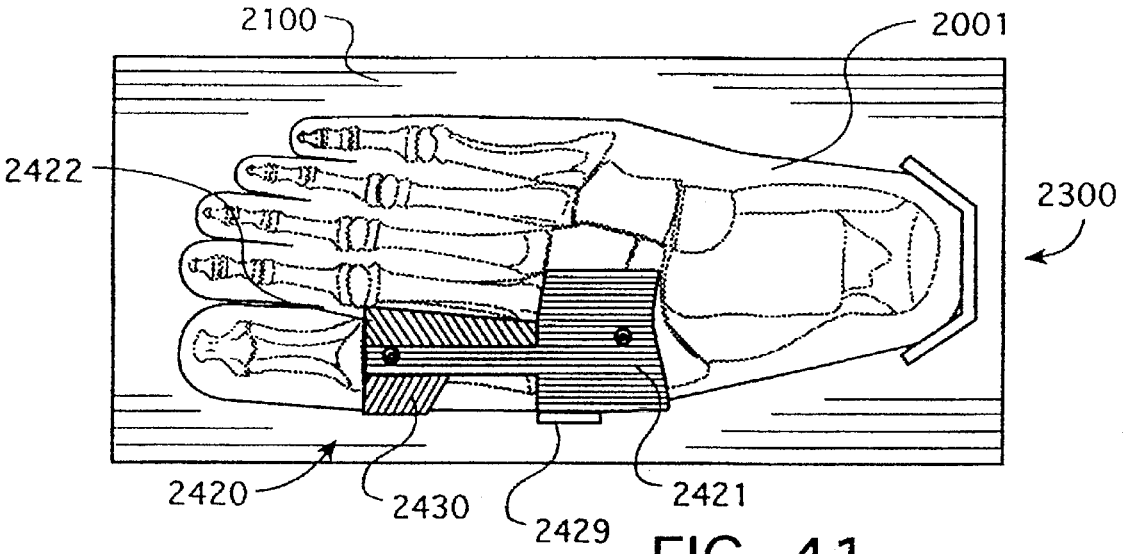

FIG. 41 shows instep counter 2420 comprised of dorsum first metatarsal/dorsum midfoot counter 2421, superolateral first metatarsal counter 2422, superomedial first metatarsal counter 2430 and medial midfoot counter 2429.

Figure 42:
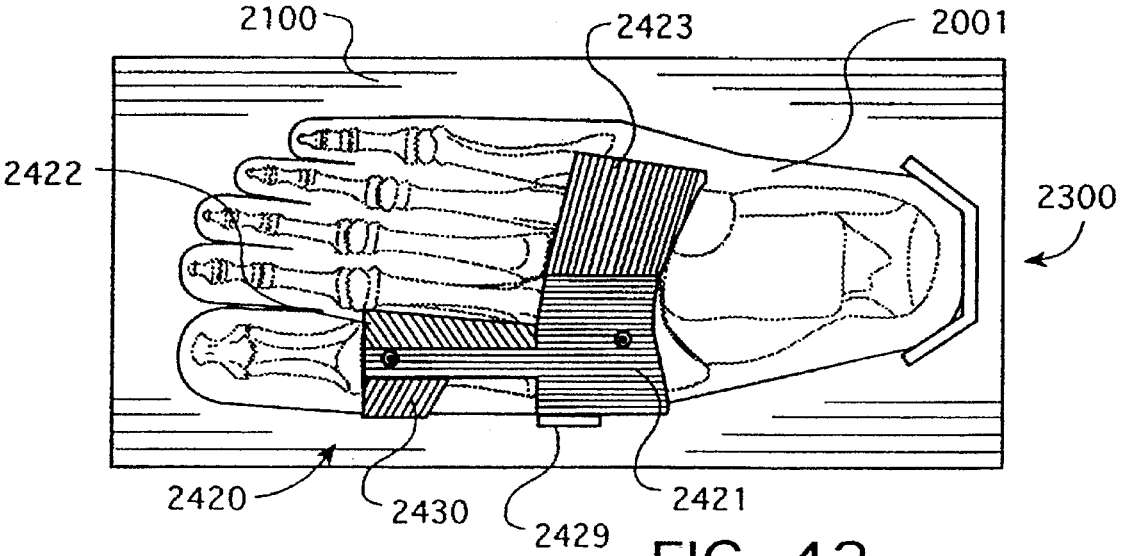

FIG. 42 is similar to FIG. 41 except that superolateral midfoot counter 2423 has been added.

The medial forefoot counter 2201, heel counter 2300 and instep counter 2420, are preferably all of a rigid material but they may be covered with a padding material for comfort.

While only preferred embodiments of the invention have been described herein in detail, the invention is not limited thereby and modifications can be made within the scope of the attached claims.

What is claimed is:

1. A footwear device comprising:

a rigid base for supporting the foot of a user thereon;

a heel counter on the rigid base for contact with the foot of a user in a first area of the foot posterior to the posterior aspect of the heel of the foot;

a medial forefoot counter for contact with the foot of a user in a second area of the foot medial to the medial aspect of the head of the first metatarsal of the foot and means for adjusting said medial forefoot counter in a direction medially/laterally with respect to said foot into different positions relative to said rigid base and including means for selectively locking said medial forefoot counter in one of said positions; and a forefoot/midfoot compression member for contact with the foot of a user in a third area of the foot located on the dorsum of said foot for exerting a downwardly and rearwardly directed force on the dorsum of the foot, the compression member including a plate in the form of a supero-lateral first metatarsal counter for applying a substantially infero-medially acting force on the supero-lateral aspect of the first metatarsal.

2. The footwear device according to claim 1, wherein said means for adjusting the medial forefoot counter comprises a slot in said rigid base for guiding said medial forefoot counter.

3. A footwear device comprising:

a rigid base for supporing the foot of a user thereon;

a heel counter on the rigid base for contact with the foot of a user in a first area of the foot posterior to the posterior aspect of the heel of the foot, means for adjusting said heel counter in a direction anteriorly/posteriorly with respect to said foot into different positions relative to said rigid base and including means for selectively locking said heel counter in one of said positions; and A forefoot/midfoot compression member for contact with the foot of a user in a third area of the foot located on the dorsum of said foot for exerting a downwardly and rearwardly directed force on the dorsum of the foot, the compression member including a plate in the form of a supero-lateral first metatarsal counter for applying a substantially infero-medially acting force on the supero-lateral aspect of the first metatarsal.

4. The footwear device according to claim 3 wherein said means for adjusting said heel counter comprises a slot in said rigid base for guiding said heel counter.

* * * * *